US007544171B2

(12) United States Patent
Schaden et al.

(10) Patent No.: US 7,544,171 B2
(45) **Date of Patent: *Jun. 9, 2009**

(54) METHODS FOR PROMOTING NERVE REGENERATION AND NEURONAL GROWTH AND ELONGATION

(75) Inventors: Wolfgang Schaden, Vienna (AT); Reiner Schultheiss, Illighausen (CH); John Warlick, Woodstock, GA (US); Robert Schmidhammer, Vienna (AT)

(73) Assignee: General Patent LLC, Marietta, GA (US)

( * ) Notice: Subject to any disclaimer, the term of this patent is extended or adjusted under 35 U.S.C. 154(b) by 255 days.

This patent is subject to a terminal disclaimer.

(21) Appl. No.: 11/238,499

(22) Filed: Sep. 29, 2005

(65) Prior Publication Data

US 2007/0239080 A1 Oct. 11, 2007

Related U.S. Application Data

(63) Continuation-in-part of application No. 11/122,154, filed on May 4, 2005, now Pat. No. 7,470,240, and a continuation-in-part of application No. 11/071,156, filed on Mar. 4, 2005.

(60) Provisional application No. 60/699,719, filed on Jul. 14, 2005, provisional application No. 60/642,149, filed on Jan. 10, 2005, provisional application No. 60/621,028, filed on Oct. 22, 2004.

(51) Int. Cl.
*A61H 1/02* (2006.01)

(52) U.S. Cl. ..... 601/2; 601/4; 600/437; 600/427

(58) Field of Classification Search ..... 601/2–4; 600/437–461, 427
See application file for complete search history.

(56) References Cited

U.S. PATENT DOCUMENTS 3,951,140 A 4/1976 Eggleton et al.

(Continued)

FOREIGN PATENT DOCUMENTS

DE 197 21 218 A1 11/1998

(Continued)

OTHER PUBLICATIONS

I R.Meireh, et al; extracorporal shock wave may enhance skin flap survival in an animal model; British Journal of Plastic Surgery; vol. 58, Issue 1, Jan. 2005, pp. 53-57.*

(Continued)

*Primary Examiner*—Brian Casler
*Assistant Examiner*—John F Ramirez
(74) *Attorney, Agent, or Firm*—David L. King

(57) ABSTRACT

A method of enhancing the regeneration of injured nerves has the step of administering an effective exposure of pressure pulses or acoustic shock waves in a pulse or wave pattern to the zone of injury of the nerve during the regeneration process. The inventive method may include enhancing the stimulation of neuronal cell growth or regeneration by administering an effective exposure of pressure pulses or acoustic shock waves in a pulse or wave pattern to stimulate neuronal cell growth or regeneration, wherein the administering of the treatment is applied to a patient who has a pathological condition where neuronal repair can be facilitated including peripheral nerve damage caused by injury or disease such as diabetes, brain damage associated with stroke, and for the treatment of neurological disorders related to neurodegeneration, including Parkinson's disease, Alzheimer's disease and amyotrophic lateral, sclerosis multiple sclerosis and disseminated sclerosis. The treatment is ideally suited for neural regeneration after a degenerative condition due to any neurological infections or any other pathological condition.

17 Claims, 9 Drawing Sheets

U.S. PATENT DOCUMENTS

| | | | | |
|---|---|---|---|---|
| 4,539,989 | A | 9/1985 | Forssmann et al. | |
| 4,807,627 | A | 2/1989 | Eisenmenger | |
| 4,868,161 | A | 9/1989 | Roberts | |
| 4,905,671 | A | 3/1990 | Senge et al. | |
| 5,119,801 | A | 6/1992 | Eizenhoefer et al. | |
| 5,173,295 | A * | 12/1992 | Wehling | 424/94.67 |
| 5,174,280 | A | 12/1992 | Gruenwald et al. | |
| 5,222,484 | A | 6/1993 | Krauss et al. | |
| 5,314,457 | A | 5/1994 | Jeutter et al. | |
| 5,419,335 | A | 5/1995 | Hartmann | |
| 5,545,124 | A | 8/1996 | Krause et al. | |
| 5,595,178 | A | 1/1997 | Voss et al. | |
| 6,036,661 | A | 3/2000 | Schwarze et al. | |
| 6,068,596 | A * | 5/2000 | Weth et al. | 600/437 |
| 6,113,560 | A | 9/2000 | Simnacher | |
| 6,186,963 | B1 | 2/2001 | Schwarze et al. | |
| 6,217,531 | B1 | 4/2001 | Reitmajer | |
| 6,368,292 | B1 * | 4/2002 | Ogden et al. | 601/2 |
| 6,390,995 | B1 | 5/2002 | Ogden et al. | |
| 6,544,987 | B2 | 4/2003 | Guo et al. | |
| 6,881,409 | B2 | 4/2005 | Gold | |
| 2002/0002345 | A1 | 1/2002 | Marlinghaus | |
| 2003/0129154 | A1 | 7/2003 | McDaniel | |
| 2004/0049134 | A1 * | 3/2004 | Tosaya et al. | 601/2 |
| 2004/0059265 | A1 * | 3/2004 | Candy et al. | 601/2 |
| 2004/0162508 | A1 | 8/2004 | Uebelacker | |
| 2005/0010140 | A1 | 1/2005 | Forssmann | |
| 2005/0038362 | A1 | 2/2005 | Schultheiss | |
| 2005/0075587 | A1 | 4/2005 | Vago | |
| 2006/0051328 | A1 | 3/2006 | Johnson | |

FOREIGN PATENT DOCUMENTS

| | | | |
|---|---|---|---|
| DE | 103 11 659 | | 9/2004 |
| EP | 0 243 947 | A1 | 4/1987 |
| EP | 0 324 711 | A2 | 1/1989 |
| EP | 1 445 758 | | 8/2004 |
| WO | WO 2005/018600 | A2 | 3/2005 |
| WO | WO 2005/063334 | A1 | 7/2005 |
| WO | WO 2005/075020 | | 8/2005 |

OTHER PUBLICATIONS

R.Meirer, et al; Extracorporal shock wave may enhance skin flap survival in an animal model; British Journal of Plastic Surgery; vol. 58, Issue 1, Jan. 2005, pp. 53-57; Copyright 2004; The British Association of Plastic Surgeons, published by Elsevier Ltd.

T. Nishida, et al; Extracorporeal Cardiac Shock Wave Therapy Markedly Ameliorates Ischemia-Induced Myocardial Dysfunction in Pigs in Vivo; Circulation; Nov. 9, 2004; Circulation. 2004; 110; pp. 3055-3061.

L.Gerdesmeyer, et al; Antibacterial Effects of Extracorporeal Shock Waves;World Fed for Ultrasound in Medicine & Biology;printed USA;Elsevier, vol. 31,No. 1, pp. 115-119, 2005.

G.Haupt, et al; Effect of Shock Waves on the Healing of Partial-Thickness Wounds in Piglets; Journal of Surgical Research, vol. 49, No. 1, pp. 45-48, Jul. 1990 Copyright 1990 by Academic Press, Inc.

Jagadeesh, G. et al;"Novel applications of micro-shock waves in biological sciences", J. Indian Inst. Sci. 2002, 82, pp. 1-10.

Thiel, M. et al; "The use of shock waves in medicine-a tool of the modern OR; an overview of basic physical principles, history and research", Min Invas Ther & Allied Technol 2000; 9(3/4) 247-253.

Huemer, Georg M. et al; "Comparison of the effectiveness of gene therapy with transforming growth factor-B or extracorporal shock wave therapy to reduce ischemic necrosis in an epigastric skin flap model in rats"; From the Clinical Department of Plastic and Reconstructive Surgery, Cardiac Surgery, Orthopedics, and the Ludwig-Boltzmann Institute for Quality Control in Plastic Surgery, Medical University Innsbruck Austria; Feb. 13, 2004; copyright 2005 by the Wound Healing Society. ISSN: 1067-1927 (Wound Rep Reg 2005;13:262-268).

* cited by examiner

METHODS FOR PROMOTING NERVE REGENERATION AND NEURONAL GROWTH AND ELONGATION

RELATED APPLICATIONS

This application is a continuation in part of U.S. patent application Ser. No. 11/122,154 filed on May 4, 2005 now U.S. Pat. No. 7,470,240 entitled "Pressure Pulse/Shock Wave Therapy Methods and an Apparatus for Conducting the Therapeutic Methods" and U.S. patent application Ser. No. 11/071,156 filed on Mar. 4, 2005 entitled "Pressure Pulse/Shock Wave Apparatus for Generating Waves Having Nearly Plane or Divergent Characteristics" and also claims benefit of priority to U.S. Provisional Patent Application Ser. No. 60/699,719 filed Jul. 14, 2005, U.S. Provisional Patent Application Ser. No. 60/621,028 filed Oct. 22, 2004 and of U.S. Provisional Patent Application Ser. No. 60/642,149 filed Jan. 10, 2005, the disclosures of which are incorporated herein by reference in their entirety.

FIELD OF THE INVENTION

This invention relates to treatments for repairing or regenerating damaged or degenerative nerve cells, tissues or organs in the neurological and nervous system of mammals, more specifically humans. The methods can be used to promote repair of neuronal damage caused by disease or physical trauma.

BACKGROUND OF THE INVENTION

In order to provide a meaningful understanding of the complexity and physiology of the nervous system an overview of the various components must be provided which explain their location, their function and overall makeup or construction before one can appreciate the various prior treatments that are currently being used to treat injuries or damage.

The nervous system of an animal coordinates the activity of the muscles, monitors the organs, constructs and processes input from the senses, and initiates actions. In animals with brains, the nervous system also generates and conducts thoughts and emotions. Thus it is the system that animates "animals". The nervous system consists basically of two types of cells, neurons and glia. Neurons are the primary cells of the nervous system. Glia are secondary cells involved in nourishment and structural support. Rapid signaling within the nervous system occurs by two primary mechanisms: within neuronal nerve fibers by way of action potentials; and between neurons by way of neurotransmitter diffusion across synapses.

The vertebrate central nervous system consists of the brain and spinal cord. These lie in the midline of the body and are protected by the skull and vertebrae respectively. This collection of billions of neurons is arguably the most complex object known. The central nervous system along with the peripheral nervous system comprise a primary division of controls that command all physical activities of a vertebrate. Neurons of the central nervous system affect consciousness and mental activity while spinal extensions of central nervous system neuron pathways affect skeletal muscles and organs in the body. The peripheral system is composed of the somatic nervous system and the autonomic nervous system, the latter being further divided as the sympathetic nervous system, the parasympathetic nervous system and the enteric nervous system. Each of these interacts with various organs, glands or muscles, providing information to and from the central nervous system. The somatic nervous system is the voluntary part of the nervous system that coordinates a body's movements, such as maintaining a particular posture and walking. The autonomic nervous system is the involuntary part of the nervous system where all of the internal maintenance is taken care of. The autonomic nervous system is then divided into the sympathetic division and parasympathetic division. The sympathetic nervous system responds to impending danger or stress, and is responsible for the increase of one's heartbeat and blood pressure, among other physiological changes, along with the sense of excitement he feels. The parasympathetic nervous system, on the other hand, is evident when a person is resting and feels relaxed, and is responsible for such things as the constriction of the pupil, the slowing of the heart, the dilation of the blood vessels, and the stimulation of the digestive and genitourinary systems.

Neurons (also spelled neurones or called nerve cells) are the primary cells of the nervous system. In vertebrates, they are found in the brain, the spinal cord and in the nerves and ganglia of the peripheral nervous system. There are three classes of neurons: afferent neurons, efferent neurons, and interneurons. Afferent neurons convey information from tissues and organs into the central nervous system. Efferent neurons transmit signals from the central nervous system to the effector cells. Interneurons connect neurons within the central nervous system. Many highly specialized types of neurons exist, and these differ widely in appearance. Characteristically, neurons are highly asymmetric in shape. Neurons consist of: the soma, or cell-body, the relatively large central part of the cell between the dendrites and the axon; the axon, a much finer, cable-like projection which may extend tens, hundreds, or even tens of thousands of times the diameter of the soma in length. This is the structure which carries nerve signals away from the neuron. Each neuron has only one axon, but this axon may undergo extensive branching and thereby enable communication with many target cells; and the dendrite, a short, branching arbor of cellular extensions. Each neuron has very many dendrites with profuse dendritic branches. These structures form the main information receiving network for the neuron. Axon and dendrites alike are typically only about a micrometer thick, while the soma is usually about 25 micrometers in diameter and not much larger than the cell nucleus it contains. The axon of a human motoneuron can be over a meter long, reaching from the base of the spine to the toes, while giraffes have single axons running along the whole length of its neck, which is several feet. Neurons communicate with one another and other cells through synapses where the axon tip of one cell impinges upon a dendrite or soma of another, or less commonly to an axon. Neurons of the cortex in mammals, such as the Purkinje cells, can have over 1000 dendrites each, enabling connections with tens of thousands of other cells. Neurons communicate with one another across synapses. This communication is usually chemically mediated by rapid secretion of neurotransmitter molecules. Pre-synaptic neurons (i.e. the neurons which release the neurotransmitter) may produce in the post-synaptic neurons (i.e. the neurons being affected by the neurotransmitter) an electrical stimulation (an electrical excitation) which will spread to the axon hillock generating an action potential which then travels as a wave of electrical excitation along the axon. Arrival of an action potential at the tip of an axon triggers the release of neurotransmitter at a synaptic gap. Neurotransmitters can either stimulate or suppress (inhibit) the electrical excitability of a target cell. An action potential will only be triggered in the target cell if neurotransmitter molecules acting on their post-synaptic receptors cause the cell to reach its threshold potential.

Another less common form of communication between neurons is through electrical synapses mediated by gap junctions. The narrow cross-section of axons and dendrites lessens the metabolic expense of carrying action potentials, although thicker axons convey the impulses more rapidly, generally speaking. Many neurons have insulating sheaths of myelin around their axons. The sheaths are formed by glial cells: oligodendrocytes in the central nervous system and Schwann cells in the peripheral nervous system. The sheath enables the action potentials to travel faster than in unmyelinated axons of the same diameter whilst simultaneously preventing short circuits amongst intersecting neurons. The myelin sheath in peripheral nerves normally runs along the axon in sections about 1 mm long, punctuated by unsheathed nodes of Ranvier. Multiple sclerosis is a neurological disorder which results from abnormal demyelination of peripheral nerves. Neurons with demyelinated axons do not conduct electrical signals properly.

Neurons and glia make up the two chief cell types of the central nervous system. There are far more glial cells than neurons, and recent experimental results have suggested that glial cells play a vital role in information processing among neurons. Nerve cell bodies stained with basophilic dyes will show numerous microscopic clumps of Nissl substance (named after German psychiatrist and neuropathologist Franz Nissl, 1860-1919), which consists of rough endoplasmic reticulum and associated ribosomes. The prominence of the Nissl substance can be explained by the fact that nerve cells are metabolically very active, and hence are involved in large numbers of protein synthesis. The cell body of a neuron is supported by a complex meshwork of structural proteins called neurofilaments, which are assembled into larger neurofibrils. Some neurons also contain pigment granules, such as neuromelanin (a brownish-black pigment, byproduct of synthesis of catecholamines) and lipofuscin (yellowish-brown pigment that accumulates with age).

The human brain has about 100 billion ($10^{11}$) neurons and 100 trillion ($10^{14}$) connections (synapses) between them. The brain receives sensory input from the spinal cord as well as from its own nerves (e.g., olfactory and optic nerves) and devotes most of its volume (and computational power) to processing its various sensory inputs and initiating appropriate and coordinated motor outputs.

Both the spinal cord and the brain consist of white matter (bundles of axons each coated with a sheath of myelin) and gray matter (masses of the cell bodies and dendrites each covered with synapses). In the spinal cord, the white matter is at the surface, the gray matter inside. In the brain of mammals, this pattern is reversed. However, the brains of "lower" vertebrates like fishes and amphibians have their white matter on the outside of their brain as well as their spinal cord.

Both the spinal cord and brain are covered in three continuous sheets of connective tissue, the meninges. From outside in, these are the dura mater pressed against the bony surface of the interior of the vertebrae and the cranium, the arachnoid and the pia mater. The region between the arachnoid and pia mater is filled with cerebrospinal fluid (CSF).

The cells of the central nervous system are bathed in a fluid that differs from that serving as the ECF of the cells in the rest of the body. The fluid that leaves the capillaries in the brain contains far less protein than "normal" because of the blood-brain barrier, a system of tight junctions between the endothelial cells of the capillaries. This barrier creates problems in medicine as it prevents many therapeutic drugs from reaching the brain. Cerebrospinal fluid (CSF), is a secretion of the choroid plexus. CSF flows uninterrupted throughout the central nervous system through the central cerebrospinal canal of the spinal cord and through an interconnected system of four ventricles in the brain. CSF returns to the blood through veins draining the brain.

In the spinal cord there are thirty-one pairs of spinal nerves which arise along the spinal cord. These are "mixed" nerves because each contain both sensory and motor axons. However, within the spinal column, all the sensory axons pass into the dorsal root ganglion where their cell bodies are located and then on into the spinal cord itself and all the motor axons pass into the ventral roots before uniting with the sensory axons to form the mixed nerves. The spinal cord carries out two main functions: it connects a large part of the peripheral nervous system to the brain. Information (nerve impulses) reaching the spinal cord through sensory neurons is transmitted up into the brain. Signals arising in the motor areas of the brain travel back down the cord and leave in the motor neurons and the spinal cord also acts as a minor coordinating center responsible for some simple reflexes like the withdrawal reflex. The interneurons carrying impulses to and from specific receptors and effectors are grouped together in spinal tracts. Impulses reaching the spinal cord from the left side of the body eventually pass over to tracts running up to the right side of the brain and vice versa. In some cases this crossing over occurs as soon as the impulses enter the cord. In other cases, it does not take place until the tracts enter the brain itself.

The brain of all vertebrates develops from three swellings at the anterior end of the neural canal of the embryo. From front to back these develop into the forebrain (also known as the prosencephalon), the midbrain (mesencephalon) and the hindbrain (rhombencephalon). The brain receives nerve impulses from the spinal cord and 12 pairs of cranial nerves. Some of the cranial nerves are "mixed", containing both sensory and motor axons, some, e.g., the optic and olfactory nerves (numbers I and II) contain sensory axons only, while some, e.g. number III that controls eyeball muscles, contain motor axons only. The main structures of the hindbrain are the medulla oblongata, the pons and the cerebellum. The medulla looks like a swollen tip to the spinal cord. Nerve impulses arising here rhythmically stimulate the intercostal muscles and diaphragm—making breathing possible, regulate heartbeat, and regulate the diameter of arterioles thus adjusting blood flow.

The pons seems to serve as a relay station carrying signals from various parts of the cerebral cortex to the cerebellum. Nerve impulses coming from the eyes, ears, and touch receptors are sent on the cerebellum. The pons also participates in the reflexes that regulate breathing. The reticular formation is a region running through the middle of the hindbrain (and on into the midbrain). It receives sensory input (e.g., sound) from higher in the brain and passes these back up to the thalamus. The reticular formation is involved in sleep, arousal (and vomiting).

The cerebellum consists of two deeply-convoluted hemispheres. Although it represents only 10% of the weight of the brain, it contains as many neurons as all the rest of the brain combined. Its most clearly-understood function is to coordinate body movements. People with damage to their cerebellum are able to perceive the world as before and to contract their muscles, but their motions are jerky and uncoordinated. So the cerebellum appears to be a center for learning motor skills (implicit memory). Laboratory studies have demonstrated both long-term potentiation (LTP) and long-term depression (LTD) in the cerebellum.

The midbrain occupies only a small region in humans (it is relatively much larger in "lower" vertebrates). It has three primary features: the reticular formation: collects input from higher brain centers and passes it on to motor neurons; the substantia nigra: helps "smooth" out body movements; damage to the substantia nigra causes Parkinson's disease; and the ventral tegmental area (VTA): packed with dopamine-releasing neurons that synapse deep within the forebrain. The VTA seems to be involved in pleasure.

The human forebrain is made up of a pair of large cerebral hemispheres, called the telencephalon. Because of crossing over of the spinal tracts, the left hemisphere of the forebrain deals with the right side of the body and vice versa and a group of unpaired structures located deep within the cerebrum, called the diencephalon. The diencephalon has 4 primary structures: the thalamus where all sensory input (except for olfaction) passes through it on the way up to the somatic-sensory regions of the cerebral cortex and then returns to it from there and signals from the cerebellum pass through it on the way to the motor areas of the cerebral cortex; the Lateral geniculate nucleus (LGN) where all signals entering the brain from the optic nerves enter the LGN and undergo some processing before moving on the various visual areas of the cerebral cortex. The hypothalamus is the seat of the autonomic nervous system (damage to the hypothalamus is quickly fatal as the normal homeostasis of body temperature, blood chemistry, etc. goes out of control). It is the source of eight hormones, two of which pass into the posterior lobe of the pituitary gland. The Posterior lobe of the pituitary which receives antidiuretic hormone (ADH) and oxytocin from the hypothalamus and releases them into the blood. Each hemisphere of the cerebrum is subdivided into four lobes visible from the outside: the frontal, the parietal, the occipital and the temporal. Hidden beneath these regions of cerebral cortex are the olfactory bulbs, the striatum, the nucleus accumbens (NA) and the limbic system. The olfactory bulbs receive input from the olfactory epithelia. The striatum receives input from the frontal lobes and also from the limbic system (below) at its base is the nucleus accumbens (NA). The pleasurable (and addictive) effects of amphetamines, cocaine, and perhaps other psychoactive drugs seem to depend on their producing increasing levels of dopamine at the synapses in the nucleus accumbens (as well as the VTA). The limbic system receives input from various association areas in the cerebral cortex and passes signals on to the nucleus accumbens. The limbic system is made up of the hippocampus, it is essential for the formation of long-term memories; and the amygdala. The amygdala appears to be a center of emotions (e.g., fear). It sends signals to the hypothalamus and medulla which can activate the flight or fight response of the autonomic nervous system. In rats, at least, the amygdala contains receptors for vasopressin whose activation increases aggressiveness and other signs of the flight or fight response; and oxytocin whose activation lessens the signs of stress. The amygdala receives a rich supply of signals from the olfactory system, and this may account for the powerful effect that odor has on emotions (and evoking memories).

Damage to the nervous system can be caused by infectious diseases or trauma. In the brain strokes, tumors as well as trauma injuries can result in damage. The onset of neural or nerve damage can be and often is progressive in the scope and rate of the degenerative condition.

U.S. Pat. No. 6,544,987 entitled "Compounds, Compositions and Methods for Stimulating Neuronal Growth and Elongation" assigned to Pfizer Inc. suggested inhibiting rotomase enzyme activity associated with binding proteins with an affinity for FKBP—type imminophilins could be a useful medicament providing methods to treat neurological trauma or disorders as a result of, or associated with, conditions that include (but are not limited to) neuralgias, muscular dystrophy, Bell's palsy, myasthenia gravis, Parkinson's disease, Alzheimer's disease, multiple sclerosis, ALS, stroke and ischemia associated with stroke, neural parapathy, other neural degenerative diseases, motor neuron diseases, and nerve injuries including spinal cord injuries.

Earlier findings of Peter Wehling in U.S. Pat. No. 5,173,295 entitled "Method of Enhancing the Regeneration of Injured Nerves and Adhesive Pharmaceutical Formulation Therefor" found the regeneration of injured nerves is enhanced by supplying collagenase to the zone of injury of the nerve. Growth of nerve sprouts over the zone of injury is aided by the presence of effective amounts of collagenase during the regeneration process. If the nerve has been severed, collagenase is supplied to the ends of the proximal and distal stumps. A nerve graft may be interposed between the stumps. Natural fibrin has been used as glue to join nerve stumps, and collagenase is effective when used in admixture with fibrin.

In U.S. Pat. No. 4,868,161 entitled "Method for Promoting Nerve Regeneration" Eugene Roberts discovered a method for promoting regeneration of damaged nerve tissue, comprising administering, either alone or in combination, an effective amount of an antimitotic agent or a proton-withdrawing buffer to the damage site. Antimitotic agents reduce the rate of growth of glial cells, and buffers facilitate the growth of nerve tissue and inhibit glial cell growth. Referred antimitotic agents are cytosine arabinoside, 5-fluorouracil, and hydroxyurea. Preferred buffers are TREA and HEPES. Compositions are disclosed which include antimitotic agent, buffer, and an oxygen-supplying compound, such as hydrogen peroxide.

In U.S. Pat. No. 6,881,409 entitled "Compositions and Methods for Promoting Nerve Regeneration", Bruce C. Gold stated, I have discovered that geldanamycin and FK506 stimulate nerve regeneration via a common mechanism. Both compounds bind to polypeptide components of steroid receptor complexes, hsp90 and FKBP52, respectively. These and other compounds that cause hsp90 dissociation from steroid receptor complexes or that block association of hsp90 with steroid receptor complexes stimulate nerve cell growth and promote nerve regeneration. Such compounds can act directly by binding to hsp90 (as in the case of geldanamycin) or indirectly by binding to another polypeptide in the steroid receptor complex (as in the case of FK506 binding of FKBP52).

According to each aspect of these prior art inventions, methods of stimulating nerve cell growth in a mammal are provided that include administering a pharmaceutical composition.

Others have suggested surgical implants of regenerative electrical stimulation to stimulate regeneration and or healing of damaged nerve tissue as is found in U.S. Pat. No. 5,314,457.

The benefits of solving the mystery of repairing damaged or degenerative conditions involving the nervous system are enormous. It appears that a solution most clearly resides in the stimulation of nerve cells or neurons, generally. More specifically in achieving a systemic release of growth factors within these cells including, but not limited to activation of proteins and or stem cells in the region of trauma or injury to the nerve cells or tissue.

It is therefore an object of the present invention to provide a means to stimulate regeneration of damaged or degenerating neurons or nerve cells in nerve fibers, nerve tissue or the brain. The means being compatible with post-operative surgical procedures and medicaments to provide an enhancing, accelerated growth outcome when used in conjunction with such therapies or can alternatively be used alone.

SUMMARY OF THE INVENTION

A method of enhancing the regeneration of injured nerves has the step of administering an effective exposure of pressure pulses or acoustic shock waves in a pulse or wave pattern to the zone of injury of the nerve during the regeneration process. The method can be used wherein the nerve has been severed and a pulse or wave pattern is administered to the ends of the proximal and distal stumps. Fibrin containing collagenase can be used as adhesive for the stumps. Also, the ends may be sutured and the sutured region may be coated with a fibrin and collagenase mixture.

If the injury has resulted in neuroma in continuity and the stumps of individual severed fascicle groups are separately co-apted, a nerve graft may be interposed between the stumps. More specifically interfascicular nerve grafts may be employed. The method may be performed wherein the injured nerves are subjected to surgical repair prior to administering the exposure to pressure pulse or acoustic shock waves or by administering one or more nerve regenerating medicaments to the patient.

The inventive method may include enhancing the stimulation of neuronal cell growth or regeneration by administering an effective exposure of pressure pulses or acoustic shock waves in a pulse or wave pattern to stimulate neuronal cell growth or regeneration, wherein the administering of the treatment is applied to a patient who has a pathological condition where neuronal repair can be facilitated including peripheral nerve damage caused by injury or disease such as diabetes, brain damage associated with stroke, and for the treatment of neurological disorders related to neurodegeneration, including Parkinson's disease, Alzheimer's disease and amyotrophic lateral sclerosis, multiple sclerosis and disseminated sclerosis. The treatment is ideally suited for neural regeneration after a degenerative condition due to any neurological infections or any other pathological condition.

DEFINITIONS

"Alzheimer's disease" is a degenerative brain disease of unknown cause that is the most common form of dementia, that usually starts in late middle age or in old age as a memory loss for recent events spreading to memories for more distant events and progressing over the course of five to ten years to a profound intellectual decline characterized by dementia and personal helplessness, and that is marked histologically by the degeneration of brain neurons especially in the cerebral cortex and by the presence of neurofibrillary tangles and plaques containing beta-amyloid.

"Amyotrophic lateral sclerosis" is a rare fatal progressive degenerative disease that affects pyramidal motor neurons, usually begins in middle age, and is characterized especially by increasing and spreading muscular weakness—abbreviation ALS; called also Lou Gehrig's disease.

A "curved emitter" is an emitter having a curved reflecting (or focusing) or emitting surface and includes, but is not limited to, emitters having ellipsoidal, parabolic, quasi parabolic (general paraboloid) or spherical reflector/reflecting or emitting elements. Curved emitters having a curved reflecting or focusing element generally produce waves having focused wave fronts, while curved emitters having a curved emitting surfaces generally produce wave having divergent wave fronts.

"Diabetes" is a variable disorder of carbohydrate metabolism caused by a combination of hereditary and environmental factors and usually characterized by inadequate secretion or utilization of insulin, by excessive urine production, by excessive amounts of sugar in the blood and urine, and by thirst, hunger, and loss of weight.

"Divergent waves" in the context of the present invention are all waves which are not focused and are not plane or nearly plane. Divergent waves also include waves which only seem to have a focus or source from which the waves are transmitted. The wave fronts of divergent waves have divergent characteristics. Divergent waves can be created in many different ways, for example: A focused wave will become divergent once it has passed through the focal point. Spherical waves are also included in this definition of divergent waves and have wave fronts with divergent characteristics.

"extracorporeal" occurring or based outside the living body.

A "generalized paraboloid" according to the present invention is also a three-dimensional bowl. In two dimensions (in Cartesian coordinates, x and y) the formula $y^n=2px$ [with n being$\neq$2, but being greater than about 1.2 and smaller than 2, or greater than 2 but smaller than about 2.8]. In a generalized paraboloid, the characteristics of the wave fronts created by electrodes located within the generalized paraboloid may be corrected by the selection of (p(−z,+z)), with z being a measure for the burn down of an electrode, and n, so that phenomena including, but not limited to, burn down of the tip of an electrode (−z,+z) and/or disturbances caused by diffraction at the aperture of the paraboloid are compensated for.

A "paraboloid" according to the present invention is a three-dimensional reflecting bowl. In two dimensions (in Cartesian coordinates, x and y) the formula $y^2=2px$, wherein p/2 is the distance of the focal point of the paraboloid from its apex, defines the paraboloid. Rotation of the two-dimensional figure defined by this formula around its longitudinal axis generates a defacto paraboloid.

"Parkinson's disease" is a chronic progressive nervous disease chiefly of later life that is linked to decreased dopamine production in the substantia nigra and is marked by tremor and weakness of resting muscles and by a shuffling gait.

"Plane waves" are sometimes also called flat or even waves. Their wave fronts have plane characteristics (also called even or parallel characteristics). The amplitude in a wave front is constant and the "curvature" is flat (that is why these waves are sometimes called flat waves). Plane waves do not have a focus to which their fronts move (focused) or from which the fronts are emitted (divergent). "Nearly plane waves" also do not have a focus to which their fronts move (focused) or from which the fronts are emitted (divergent). The amplitude of their wave fronts (having "nearly plane" characteristics) is approximating the constancy of plain waves. "Nearly plane" waves can be emitted by generators having pressure pulse/ shock wave generating elements with flat emitters or curved emitters. Curved emitters may comprise a generalized paraboloid that allows waves having nearly plane characteristics to be emitted.

A "pressure pulse" according to the present invention is an acoustic pulse which includes several cycles of positive and negative pressure. The amplitude of the positive part of such a cycle should be above about 0.1 MPa and its time duration is from below a microsecond to about a second. Rise times of the positive part of the first pressure cycle may be in the range of nano-seconds (ns) up to some milli-seconds (ms). Very fast pressure pulses are called shock waves. Shock waves used in medical applications do have amplitudes above 0.1 MPa and rise times of the amplitude are below 100's of ns. The duration of a shock wave is typically below 1-3 micro-seconds (μs) for the positive part of a cycle and typically above some micro-seconds for the negative part of a cycle.

"Stroke" is a sudden diminution or loss of consciousness, sensation, and voluntary motion caused by rupture or obstruction (as by a clot) of a blood vessel of the brain.

Waves/wave fronts described as being "focused" or "having focusing characteristics" means in the context of the present invention that the respective waves or wave fronts are traveling and increase their amplitude in direction of the focal point. Per definition the energy of the wave will be at a maximum in the focal point or, if there is a focal shift in this point, the energy is at a maximum near the geometrical focal point. Both the maximum energy and the maximal pressure amplitude may be used to define the focal point.

BRIEF DESCRIPTION OF THE DRAWINGS

The invention will be described by way of example and with reference to the accompanying drawings in which.

DETAILED DESCRIPTION OF THE INVENTION

The present invention relates to the use of various therapeutic pressure pulse wave patterns or acoustic shock wave patterns as illustrated in FIGS. 1-12 for treating nerve damage or various neurological diseases or conditions or for preventing such conditions from occurring. Each illustrated wave pattern will be discussed later in the description; however, the use of each has particularly interesting beneficial features that are a remarkably valuable new tool in the fight against such diseases.

Figure 13:
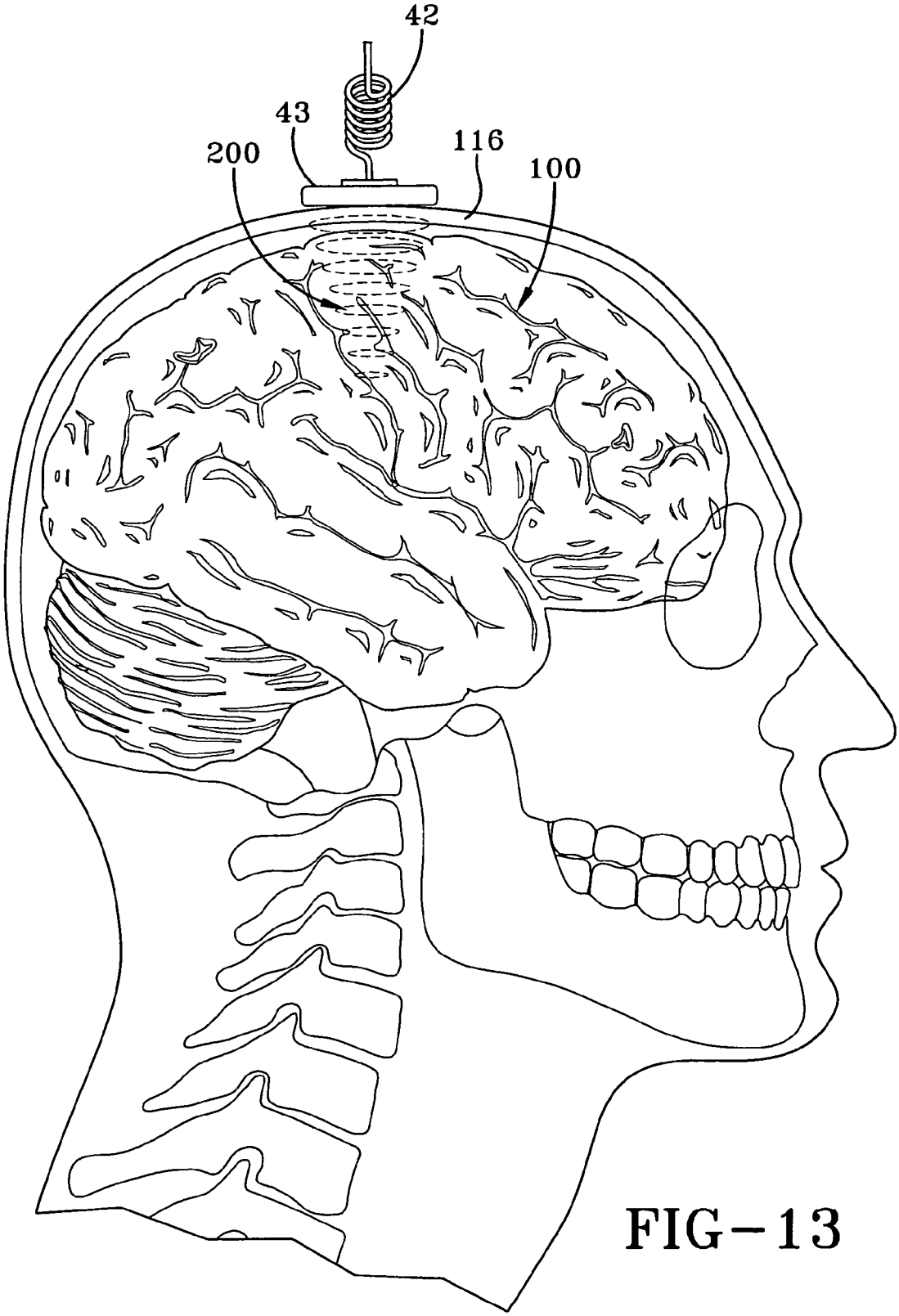
FIG. 13 shows a patient being treated extracorporeally with shock waves being transmitted through the skin and cranial bone tissue to the neurological region to be treated.

With reference to FIG. 13, a perspective view of a portion of the treatment region 200 is shown. The neurological tissue 100, more commonly referred to as the brain 100, is the principal source of neurological activity.

Shock waves are a completely different technology and a quantum leap beyond other forms of neurological treatments. The mechanism of shock waves is far from being understood, but is known to cause new blood vessels to grow in an area of treatment and regenerate bony tissue. In the present invention shock waves are used to treat nerve damage or neurological disease by regenerating or repairing the neurological tissue or nerve architecture to be regenerated. This is a phenomenal advancement in the current approach which includes difficult surgery. If surgery could be replaced in many cases, it would save millions of dollars, gain wide acceptance (non-invasive) and be a tremendous benefit to patients world wide.

The present invention employs the use of pressure pulses or shock waves to stimulate a neuron or cellular nerve response stimulating a tissue regenerative healing process that activates the tissue or nerve cells surrounding the damaged nerves as well as the damaged nerves or neurons to initiate a systemic healing process.

In the pressure pulse or shock wave method of treating a tissue, an organ or the entire body of a host be it mechanical system or a mammal, the host system or mammal be it human or an animal with a risk of degenerative neurological or nerve damage or post-occurrence of such damage requires the host patient to be positioned in a convenient orientation to permit the source of the emitted waves to most directly send the waves to the target site to initiate pressure pulse or shock wave stimulation of the target area or zone with minimal, preferably with little or no obstructing features in the path of the emitting source or lens. Assuming the treatment region is accessible through an open surgical access region then the shock wave head 43 can be inserted and placed directly on or adjacent to the treatment region 200. Alternatively the shock wave head 43 can be placed externally on the skull and transmit the emitted shock wave patterns through the skin, cranial bone tissue 116 for example and into the adjacent brain tissue 100 to be treated, as shown in FIG. 13. In the case of extracorporeal non-invasive treatments of damaged nerves, preferably the outer skin tissue is pressed against the treatment region to insure the transmission loss is minimal. In some cases the treatment zone may benefit or require numbing prior to treatments in advance of surgical procedures. This is particularly true if the use of high energy focused waves are being transmitted through bone tissue to stimulate the sensitive nerves in the treatment area. Assuming the target area or site is within a projected area of the wave transmission, a single transmission dosage of wave energy may be used. The transmission dosage can be from a few seconds to 20 minutes or more dependent on the condition. Preferably the waves are generated from an unfocused or focused source. The unfocused waves can be divergent, planar or near planar and having a low pressure amplitude and density in the range of 0.00001 $mJ/mm^2$ to 1.0 $mJ/mm^2$ or less, most typically below 0.2 $mJ/mm^2$. The focused source preferably can use a diffusing lens or have a far-sight focus to minimize if not eliminate having the localized focus point within the tissue. Preferably the focused shock waves are used at a similarly effective low energy transmission or alternatively can be at higher energy but wherein the tissue target site is disposed pre-convergence inward of the geometric focal point of the emitted wave transmission. In treating some hard to penetrate regions, the pressure pulse more preferably is a high energy target focused wave pattern which can effectively penetrate through outer structures prior to being dampened while still exposing the nerves or neurons to activating pressure pulses or shock waves. This emitted energy preferably stimulates the cells without rupturing cellular membranes. The surrounding healthy cells in the region treated are activated initiating a defense mechanism response to assist in eradication of the unwanted infection or diseased tissue while stimulating new growth.

These shock wave energy transmissions are effective in stimulating a cellular response and can be accomplished without creating the cavitation bubbles in the tissue of the target site when employed in other than site targeted high energy focused transmissions. This effectively insures the tissue or organ does not have to experience the sensation of hemorrhaging so common in the higher energy focused wave forms having a focal point at or within the targeted treatment site.

If the target site is an organ like the brain subjected to a surgical procedure exposing at least some if not all of the organ within the body cranial cavity the target site may be such that the patient or the generating source must be reoriented relative to the site and a second, third or more treatment dosage can be administered. The fact that some if not all of the dosage can be at a low energy the common problem of localized hemorrhaging is reduced making it more practical to administer multiple dosages of waves from various orientations to further optimize the treatment and cellular stimulation of the target site. Heretofore focused high energy multiple treatments induced pain and discomfort to the patient. The use of low energy focused or un-focused waves at the target site enables multiple sequential treatments.

The present method may need precise site location and can be used in combination with such known devices as ultrasound, cat-scan or x-ray imaging if needed. The physician's general understanding of the anatomy of the patient may be sufficient to locate the target area to be treated. This is particularly true when the exposed nerve tissue or portion of the trauma to the body or organ is visually within the surgeon's line of sight and this permits the lens or cover of the emitting shock wave source to impinge on the affected organ or tissue directly or through a transmission enhancing gel, water or fluid medium during the pressure pulse or shock wave treatment. The treated area can withstand a far greater number of shock waves based on the selected energy level being emitted. For example at very low energy levels the stimulation exposure can be provided over prolonged periods as much as 20 minutes if so desired. At higher energy levels the treatment duration can be shortened to less than a minute, less than a second if so desired. The limiting factor in the selected treatment dosage is avoidance or minimization of surrounding cell hemorrhaging and other kinds of damage to the surrounding cells or tissue while still providing a stimulating stem cell activation or a cellular release or activation of proteins such as brain derived neurotropic factor (BDNF) or VEGF and other growth factors while simultaneously germicidally attacking the degenerative tissue or infectious bacteria at the wound site.

Due to the wide range of beneficial treatments available it is believed preferable that the optimal use of one or more wave generators or sources should be selected on the basis of the specific application. Wherein relatively small target sites may involve a single wave generator placed on an adjustable manipulator arm. A key advantage of the present inventive methodology is that it is complimentary to conventional medical procedures. In the case of any operative surgical procedure the surgical area of the patient can be bombarded with these energy waves to stimulate cellular release of healing agents and growth factors. This will dramatically reduce the healing process time. Most preferably such patients may be provided more than one such treatment with an intervening dwell time for cellular relaxation prior to secondary and tertiary post operative treatments.

The underlying principle of these pressure pulse or shock wave therapy methods is to enrich the treatment area directly and to stimulate the body's own natural healing capability. This is accomplished by deploying shock waves to stimulate strong cells in the surrounding tissue to activate a variety of responses. The acoustic shock waves transmit or trigger what appears to be a cellular communication throughout the entire anatomical structure, this activates a generalized cellular response at the treatment site, in particular, but more interestingly a systemic response in areas more removed from the wave form pattern. This is believed to be one of the reasons molecular stimulation can be conducted at threshold energies heretofore believed to be well below those commonly accepted as required. Accordingly not only can the energy intensity be reduced in some cases, but also the number of applied shock wave impulses can be lowered from several thousand to as few as one or more pulses and still yield a beneficial stimulating response. The key is to provide at least a sufficient amount of energy to activate healing reactions.

In the case of nerve trauma, Peter Wehling of Germany in U.S. Pat. No. 5,173,295 which is being incorporated herein by reference in its entirety, recites the conventional techniques for nerve repair, portions of which are recited below.

The purpose of all nerve repair techniques is to restore continuity of the nerve trunk, including all its elements, in order to achieve optimal reinnervation of the end organs. According to Millesi and Terzis (1984), the four basic steps of nerve repair can be defined as:

1. Preparation of the stumps, often involving resection or interfascicular dissection with separation of individual fascicles or groups of fascicles.
2. Approximation, with special reference to the length of the gap between the stumps as well as the amount of tension present.
3. Co-aptation of the nerve stumps. Co-aptation describes the opposition of corresponding nerve ends with special attention to bringing the cross-section of the fascicles into optimal contact. A direct co-aptation (neurorrhaphy) can oppose stump to stump, fascicle to fascicle, or fascicle group to fascicle group in the corresponding ends. An indirect co-aptation can be performed by interposing a nerve graft.
4. Maintenance of co-aptation, involving the use of, for example, stitches glue or a natural fibrin clot as glue.

Epineural Repair: Co-aptation of the nerve stumps by suturing the external epineurium is a classic method of nerve repair (Zachary & Holmes, 1946; Zachary, 1954; Edshage, 1964; Moberg, 1964; Braun, 1980; Snyder, 1981; Wilgis, 1982). An important step is the initial debridement of the nerve edges, which can be carried out by the use of soft membranous material wrapped circumferentially around the nerve to make the end firm enough to be cut with a scalpel or a pair of scissors. Cooling of the end has been used clinically (Edshage & Niebauer, 1966) and experimentally (de Medinaceli et al., 1983) to ensure sharp resection surfaces and facilitate the co-aptation. If the nerve has been sharply cut by the damage (glass, knife), there is usually no reason for further debridement before the repair is performed. The cut surface of the nerve may show protrusion of fascicular contents; if not too extensive, this should be accepted in order to avoid further trauma. Landmarks such as longitudinal epineural blood vessels are identified to ensure a correct rotation of the nerve stumps, and the fascicural pattern of the cut ends should be identified under high magnification, to further ensure correct matching of the ends when the suture is performed. The sutures are placed circumferentially in the epineurium of both stumps, initially at points where external landmarks make the correct rotation crystal clear. Further stitches are then placed around the circumference to secure and maintain the initial orientation. Due to postoperative edema, the nerve ends swell considerably during the first few days, and if the sutures are too tight the ends will be strangulated. It is therefore important to make the sutures very loose. The number of sutures should be as few as possible, and no more than are needed to hold the ends close enough together with sufficient strength.

The advantage of the epineural suture technique is its simplicity and the minimal dissection trauma required however, the technique does not ensure an absolutely correct matching of the fascicular structures over the nerve trunk. It was demonstrated by Edshage (1964) that the epineural suture technique may cause misalignment and considerable displacement of fascicles in spite of a perfect superficial appearance of the epineural adaptation.

Fascicular Repair: The object of fascicular repair, or more correctly "group fascicular repair" is to achieve an optimal orientation by approximating and adapting fascicles or groups of fascicles individually (Sunderland, 1981; Kurze, 1964; Smith, 1964; Bora, 1967; Hakstian, 1968; Grabb et al., 1970; Millesi, 1973; Cabaud et al., 1976, 1980; Ito et al., 76; van Beek & Kleinert, 1977; Terzis & Strauch, 1978; Lilla et al., 1979; Terzis, 1979; Tupper, 1980; Kline et al., 1981; Kutz et al., 1981). Fascicular groups are carefully freed by dissection under high magnification, and the epineural tissue is resected over a short distance from the cut nerve.

Corresponding fascicular structures in both cut nerve ends should be inspected under high magnification, and co-aptation with exact matching of the fascicular groups is accomplished by placing 9-0 or 10-0 sutures in the interfascicular epineurium. Co-aptation by placing suture material in the perineurial sheath of individual fascicles is associated with extensive dissection trauma and makes sense only in nerves with few fascicles. The risk of damaging fascicles should be realized. Sutures penetrating the perineurium might induce microherniation of endoneurial contents and may delay restoration of an optimal endoneurial environment.

With the introduction of microsurgical techniques, the fascicular repair technique became popular, and vast clinical experience has now been gained. The repair does not resist much tension, and can therefore usually be carried out only as a primary procedure when no resection is required. Its advantage is the possibility of achieving an optimal matching of corresponding fascicular components. Resection of epineural tissue serves to remove the most reactive connective tissue of the nerve and can facilitate the fascicular matching. However, resection of epineurium combined with separation of fascicular groups may induce considerable tissue trauma; including vascular injury and postoperative edema. The method has therefore the potential disadvantage of surgical trauma added to the original injury. Fascicular repair requires optical magnification and can be carried out only by a skilled and experienced microsurgeon.

Nerve Grafting: Direct suture of the ends of a severed or lacerated nerve is not always possible to perform. When a nerve transection is treated secondarily, it is normally necessary to resect a scarred area around the site of a lesion in order to achieve fresh resection surfaces. After this is done, the nerve ends cannot always be brought together without considerable tension. Advanced lesions, including damage to a segment of a nerve, may result in a gap in the continuity of the nerve trunk.

Although tension can to some extent be overcome by mobilization of the nerve ends and flexion of adjacent joints, it has become apparent over recent years that tension at a suture line is disadvantageous for axonal growth. Even a slight tension can interfere with intraneural microvascular flow, compromising the nutrition of cellular components in both nerve ends. It has also been demonstrated that tension at the suture line increases scar tissue formation and decreases the quality of axonal regeneration (Millesi et al., 1972a; 1976; Samii & Wallenberg, 1972; Orgel & Terzis, 1977; Miyamoto & Tsuge, 1981a; b; Millesi & Meissl, 1981). Tension reduces the transsectional area of the fascicles, thereby increasing normal endoneurial fluid pressure on the other hand, minimal tension is not necessarily disadvantageous to axonal growth since such directed mechanical "microforces" might help to create longitudinal polarization of the fibrin clot occurring between two cut nerve ends, thus providing contact guidance for the advancing sprouts. In chamber experiments where a gap is left between the nerve ends, contractile forces in the fibrin clot contribute to the creation of a longitudinally-oriented stroma guiding axons growing toward the distal nerve segment.

Since experimental and clinical experience show that too much tension at the suture line is disadvantageous for axonal regrowth, most authors today prefer to avoid tension by bridging the gap with nerve grafts. Although this procedure has created new opportunities to achieve functionally good results even in severe nerve injuries (Millesi, 1977, 1980y 1984; Millesi et al., 1972b, 1976; Wilgis, 1982), not all authors agree on the critical length of the defect which should indicate the use of a nerve graft. At a panel discussion on this subject (Millesi, 1977) the opinions varied from 1.5 to 2 cm (Brunelli, Freilinger, Samii, Buck-Gramcko) to 4 mm (Kutz & Wilgis) and 6-7 cm (Urbaniak & Gaul).

Regeneration through nerve grafts has been studied experimentally in rabbits (Hudson et al., 1972) and rats (Miyamoto et al., 1981; Lundborg et al., 1982; MacKinnon, 1986). Extensive compartmentation has been observed at both the proximal and distal anastamoses (Hudson et al., 1972) and along the body of the graft (MacKinnon, 1986). Extrafascicular fibers have been observed growing in the epineurium of the graft along its whole length (4 cm in rats) (MacKinnon, 1986). Although fiber counts suggested that these fibers never made functional connections. By 4 to 6 months postoperatively, the total number of fibers in the proximal segment had become constant, while there was still an increased number of smaller diameter fibers in the graft and distal segments More fibers were present in the graft than in the distal segment indicating axonal branching at the first suture line and actual loss of fibers at the second suture line. No correlation was found between length of graft (rat peroneal nerve-length up to 2.5 cm) and number/maturation of regenerating fibers (Miyamoto et al., 1981).

Survival of Graft: The purpose of introducing grafts between the two ends of a cut nerve is to offer mechanical guidelines as well as an optimal environment for the advancing sprouts. In this respects the Schwann cells of the grafts and their basal laminae play an essential role. Laminin, located in the basal lamina of Schwann cells, is known to promote neurite growth and there are reasons to believe that certain proteins synthesized by the Schwann cells exert a neuronotrophic effect. If a thin nerve graft is placed in a healthy well vascularized bed, it will survive and will be able to fulfill this purpose. It has been demonstrated by isotope techniques that most transplanted Schwann cells in such a situation survive, multiply, form Bungner bands and remain confined to the grafted segment (Aguayo et al., 1976a, b, 1979; Charron et al., 1976; Aguayo & Bray, 1980; Aguayo, 1981). During the first day the graft survives by diffusion from the surrounding tissues. It is then revascularized rapidly, starting on the third postoperative day (Almgren, 1974). Thicker grafts have difficulties in surviving because of longer diffusion distances and delayed revascularization. The so-called "trunk graft" used in the past (for historical review, see Wilgis, 1982) usually showed a central necrosis because of its thickness.

Interfascicular Nerve Grafts: Millesi and his colleagues have shown that a gap in continuity in a nerve trunk is best treated with interfascicular nerve grafts performed with the aid of microsurgical techniques (Millesi et al., 1972b, 1976). The technical details of this procedure have been described in many excellent reviews (Millesi et al., 1972a, 1976; Millesi, 1977v 1980, 1981a, b. 1984; Wilgis, 1982). It is usually performed as a secondary procedure at a time when both the retracted nerve ends may be united by abandoned scar formations. Briefly, the dissection procedure is performed from normal to abnormal tissues. The epineurium is incised to make possible the identification of groups of fascicles. Separate groups are dissected free and traced towards the site of injury. At the point where the fascicles lose their normal appearance and run into the neuroma, the group is transected. The epineurium is excised over a distance of 1-1.5 cm from the resection borders. In order to avoid a circumferential scar; each fascicular group should be transected at a different level.

The transsectional surfaces are studied under high magnification, and the patterns are mapped in order to identify corresponding fascicular groups. This process may be associated with considerable problems since the fascicular pattern of a nerve changes continuously along the medial course of the nerve. Moreover, the fascicular pattern of the graft does not correspond to the fascicular pattern of the nerve ends.

In nerves with fascicles arranged in groups, corresponding fascicle groups should be united by individual nerve grafts (interfascicular nerve grafts). In polyfascicular nerves without group arrangement, the fascicles may be distributed diffusely over the cross-sectional area, an arrangement which is particularly common proximally at the root level or the brachial plexus. In such cases, each sector of the cross-section should be covered by a nerve graft until the whole cross-section is complete, so-called sectoral nerve grafting (Millesi, 1980).

Source of Nerve Graft: The most common choice is the sural nerve, which has an appropriate thickness and which can be harvested in considerable lengths from both lower limbs. The sural nerve has a varying pattern ranging from monofascicular to polyfascicular, and only a few branches (Millesi, 1981b) other suitable choices are the lateral or medial antebrachial cutaneous nerves (McFarlane & Myers, 1976). The terminal parts of the posterior interosseous nerves have been used as a graft in terminal lesion of digital nerves (Wilgis & Maxwell, 1979). In rarer instances, the superficial radial or lateral femoral cutaneous nerves can be used. The graft should be reserved to avoid loss of axons through branchings (Ansselin & Davey, 1986).

According to the concept of grafting, no tension at all should be tolerated at the suture lines between the graft and host nerves. The aptation could therefore be maintained by only one or two stitches of very tiny suture material (e.g., 10-0 nylon) and even fibrin clotting may be sufficient to maintain the co-aptation if tension is completely avoided (Millesi, 1980; Futami et al, 1983; Kuderna, 1985).

A problem can sometimes occur at the distal suture line where scar formation may present an obstacle to the advance of the axonal sprouts.

Free Vascularized Nerve Grafts: It is known from experimental studies that single segmental extrinsic vessels approaching a nerve trunk can maintain the intrinsic microcirculation in the nerve over long distances. It is tempting to apply this to microvascular techniques and insert free vascularized nerve grafts in gaps in nerve continuity: if the recipient bed is heavily scarred, a conventional non-vascularized nerve graft may not be optimally vascularized. In experiments on rats, the number and average diameter of regenerating axons has been found to be greater in vascularized nerve grafts than in free non-vascularized grafts (Koshima & Harii, 1981), and regenerating axons have been reported to grow at considerably greater speed in vascularized nerve grafts than in free nerve grafts (Koshima et al., 1981).

The concept of vascularized nerve grafts was introduced by Taylor and Ham (1976) and the technique has more recently been described by, among others, Breidenbach and Terzis (1984, 1987), Boney et al. (1984), and Gilbert (1984). Five cases of segmental vascularized nerve grafts bridging scarred beds for digital sensory nerve reconstruction where previous non-vascularized nerve grafts had failed were reported by Rose and Kowalski (1985). They reported good recovery of sensibility, including average static two-point discrimination of around 9 mm.

Because of the expense, time and technical expertise required, vascularized nerve grafts must be reserved for very special occasions, primarily cases where normal revascularization of the grafts cannot be expected to take place. Among other possible advantages of vascularized nerve grafts used in a scarred recipient bed might be their ability to act as vascular carriers of non-vascularized nerve graft (Breidenbach & Terzis, 1984).

Nerve Lesion in Continuity: Peripheral nerve lesions with preserved continuity of the nerve trunk but loss of distal function to varying extents constitute one of the greatest challenges in peripheral nerve surgery. Such partial loss of function might result from subtotal nerve transections, blunt nerve trauma or traction injuries. Various fiber components of the nerve trunk can, in such cases, present all stages from simple neurapraxia (Sunderland grade 1) to neurotmesis (Sunderland grades 3-5). While some axons may be transected or ruptured, others may be compressed by interneural scar or compromised by vascular insufficiency. The approach to this type of injury, also called "neuroma in continuity" is extremely difficult. In these cases the surgeon may supply collagenase to the zone of injury, in accordance with the present invention. Surgical exploration, including neurolysis or resection and reconstruction, might also be indicated if the permanent situation cannot be accepted. In such cases, applying collagenase at the point of surgical intervention facilitates nerve regeneration.

The surgeon, if experienced with the type of lesion, may by inspection under high magnification be able to gauge to some extent which fascicles are healthy and should be spared and which are damaged and should be resected and replaced. However, with this method the findings can often be misleading and methods for intraoperative assessment of fiber function with electrophysiological recording techniques have been developed. Kline et al. (1968, 19691 1972) introduced techniques for intraoperative neurophysiological assessment of the extent of the lesion by stimulating and recording from whole nerves With the development of microsurgical techniques, more refined methods for stimulation and recording from individual fascicles or fascicular groups became available. Hakstian (1968) introduced a method of stimulating motor and sensory fascicles separately in the proximal and distal nerve segments to improve accuracy in experimental nerve suture, and similar techniques have long been utilized to assess the quality of nerve regeneration following various types of nerve repair (Terzis et al., 1975, 1976; Terzis & Williams, 1976).

On the basis of these investigations, single fascicular recordings have been successfully used as an intraoperative diagnostic tool in microsurgical repair of nerve lesions in continuity (Kline & Nulsen, 1972; Williams & Terzis, 1976; Kline, 1980; Terzis et al., 1980). According to these principles, single fascicles or, if that is not possible, groups of fascicles are freed by dissection and isolated proximal and distal to the lesion Each individual fascicle is lifted onto stimulating and recording electrodes, electrical stimuli are delivered proximally and a nerve compound action potential (CAP) is recorded distally to the lesion. On the basis of the conduction velocity as well as the shape and amplitude of the wave form, the degree of nerve injury can be assessed and a decision made regarding the treatment of the fascicle. If there is a measurable response, intraneural neurolysis might be justified while absence of any response might indicate resection and grafting of the damaged fascicle.

The present invention can be used in combination with each of these nerve repair techniques and exposure to such pressure pulses or shock waves greatly accelerate the nerve repair healing time which accordingly enhances the likelihood of successful recovery of nerve function.

In clinical rat studies the remarkable re-growth of cut sciatic nerves has been demonstrated. The study involved cutting about 1.5 cm of the sciatic nerve, turning it 180° and suturing the cut ends back to the nerve (this model represents a nerve graft), closing the skin, followed by localized treatment using the present invention technology Co-inventor, Dr. Wolfgang Schaden, found that the nerves reattached/regenerated themselves better in cases where shock waves were applied. In addition, it was found that treated rats had a higher concentration of a certain protein in the brain that is common with well trained rats (i.e. rats undergoing physiotherapy).

The trial was a 3 tailed study: 1st group of rats: dissection of the sciatic nerve and immediate microsurgical suture of the nerve. This was the control group. 2nd group: this group had the same procedure but after suturing the skin immediately shockwaves were applied. 3rd group: resection of 1.5 cm of the sciatic nerve and microsurgical suture upside-down (nerve graft model). After suturing the skin immediately shockwave therapy. Till now we have the following results: Group 1 had the expected results of sutured nerves (compared to historical study groups). Group 2 and even group 3 were clinically better than group 1. Group 2 and 3 were also better in electromyographical examinations. Both shockwave groups had significant higher levels of BDNF as the control group, but even higher levels than trained rats (based on historical comparison to trials that have been previously performed).

Dr. Robert Schmidhammer who performed the nerve trials in Austria found the protein he could prove to be produced in the brain of the rats of the shock wave therapy is called brain derived neurotropic factor (BDNF). The concentration of this protein in the shock wave treated rats was even higher than in trained rats.

These studies relied on the stimulation of the rats own natural healing ability after exposure to a shock wave treatment. The control group of rats had generally a failure to reattach and as expected no return of nerve function. This exposure to shock waves enhancing the neurological brain activity in the treated rats proves the overall systemic response of the nervous system to regenerative growth and repair after shock wave exposure at least on lower mammals such as rats.

This finding has led to the projected use of such treatments on humans for regenerative repair of degenerative conditions, the clinical studies so far indicating the same improvements can be anticipated in primates including humans.

The use of shock waves as described above appears to involve factors such as thermal heating, light emission, electromagnetic field exposure, chemical releases in the cells as well as a microbiological response within the cells. Which combination of these factors plays a role in stimulating neurological healing is not yet resolved. However, there appears to be a commonality in the fact that growth factors are released which applicants find indicative that otherwise dormant cells within the nerve tissue appear to be activated which leads to the remarkable ability of the targeted area to generate new growth or to regenerate weakened vascular networks or blood circulation in for example to assist in nerve regeneration. This finding leads to a complimentary use of shock wave therapy in combination with stem cell therapies that effectively activate or trigger stem cells to more rapidly replicate enhancing the ability to harvest and culture more viable cells from the placenta, a nutrient culture of said stem cells, or other sources. The ability to stimulate stem cells can occur within the patients own body activating the naturally occurring stem cells or stem cells that have been introduced to the patient as part of a treatment beneficially utilizing stem cells. This is a significant clinical value in its own right.

In one embodiment, the invention provides for germicidal cleaning of diseased or infected areas and for wound cleaning generally after exposure to surgical procedures.

The use of shock wave therapy requires a fundamental understanding of focused and unfocused shock waves, coupled with a more accurate biological or molecular model.

Focused shock waves are focused using ellipsoidal reflectors in electromechanical sources from a cylindrical surface or by the use of concave or convex lenses. Piezoelectric sources often use spherical surfaces to emit acoustic pressure waves which are self focused and have also been used in spherical electromagnetic devices.

The biological model proposed by co-inventor Wolfgang Schaden provides a whole array of clinically significant uses of shock wave therapy.

Accepting the biological model as promoted by W. Schaden, the peak pressure and the energy density of the shock waves can be lowered dramatically. Activation of the body's healing mechanisms will be seen by in growth of new blood vessels and the release of growth factors.

The biological model motivated the design of sources with low pressure amplitudes and energy densities. First: spherical waves generated between two tips of an electrode; and second: nearly even waves generated by generalized parabolic reflectors. Third: divergent shock front characteristics are generated by an ellipsoid behind F2. Unfocused sources are preferably designed for extended two dimensional areas/volumes like skin. The unfocused sources can provide a divergent wave pattern a planar or a nearly planar wave pattern and can be used in isolation or in combination with focused wave patterns yielding to an improved therapeutic treatment capability that is non-invasive with few if any disadvantageous contraindications. Alternatively a focused wave emitting treatment may be used wherein the focal point extends preferably beyond the target treatment site, potentially external to the patient. This results in the reduction of or elimination of a localized intensity zone with associated noticeable pain effect while providing a wide or enlarged treatment volume at a variety of depths more closely associated with high energy focused wave treatment. The utilization of a diffuser type lens or a shifted far-sighted focal point for the ellipsoidal reflector enables the spreading of the wave energy to effectively create a convergent but offtarget focal point. This insures less tissue trauma while insuring cellular stimulation to enhance the healing process and control the migration or spreading of the infection within the host The unfocused shock waves can be of a divergent wave pattern, planar or near planar pattern preferably convergent diffused or far-sighted wave pattern, of a low peak pressure amplitude and density. Typically the energy density values range as low as 0.000001 $mJ/mm^2$ and having a high end energy density of below 1.0 $mJ/mm^2$, preferably 0.20 $mJ/mm^2$ or less. The peak pressure amplitude of the positive part of the cycle should be above 1.0 and its duration is below 1-3 microseconds.

The treatment depth can vary from the surface to the full depth of the treated organ. The treatment site can be defined by a much larger treatment area than the 0.10-3.0 $cm^2$ commonly produced by focused waves. The above methodology is particularly well suited for surface as well as sub-surface soft tissue organ treatments like the brain.

The above methodology is valuable in generation of nerve tissue, vascularization and may be used in combination with stem cell therapies as well as regeneration of damaged nerve or neurological tissue and vascularization.

The methodology is useful in (re)vascularization and regeneration of not only neurological tissue such as the brain, but also the heart, liver, kidney, skin, urological organs, reproductive organs and digestive tract.

The methodology is useful in stimulating enforcement of defense mechanisms in tissue cells to fight infections from bacteria and can be used germicidally to treat or cleanse wounds or other infected or degenerative target sites which is a primary concern in the case of treating human neurological diseases such as Alzheimer's disease, Parkinson's or ALS, resulting from such exposures to infectious or degenerative type agents.

While the above listed indications cited above are not exhaustive nor intended to be limiting, it is exemplary of the wide range of beneficial uses of high energy focused or low energy and amplitude unfocused divergent, planar or nearly planar shock waves, convergent shock waves, diffused shock waves or a combination of shock wave types in the treatment of humans and other mammals that are exposed to a neurological trauma or disease affecting the nervous system or are at high risk to be so exposed as the result of a high potential genetic pre-disposition to such diseases.

A most significant method of preventive medicine can be practiced that is fully enabled by the use of these relatively low amplitude and pressure shock waves. The method includes the steps of identifying high risk patients for a variety of potential risk conditions. Such condition could be by way of example, any degenerative neurological disease or loss of feeling or circulation in a target region. After identifying a risk prone candidate providing one or a series of two or more exposure treatments with focused or unfocused, divergent, planar or near planar shock waves or convergent far-sighted focused shock waves or diffused shock waves to the treatment site, in this example the region surrounding or in proximity to an occurrence risk location. Then after treatments the physician can optionally ultrasound visually or otherwise determine the increase in regeneration or vascularization in the treated tissue after a period of time. Assuming an initial baseline determination of the neurological cell or nerve tissue regeneration or vascularization had been initially conducted an estimate or calculation of dosage requirements can be made. This procedure can be used for any at risk condition. After a surgical repair procedure the surrounding tissues can be post-operatively shock wave treated as well.

The implications of using the (re)generative features of this type of shock wave therapy are any weakened organ or tissue can be strengthened to the point of reducing or eliminating the risk of irreparable damage or failure as a result of microbial infections or genetic pre-disposition.

The stimulation of growth factors and activation of healing acceleration within the cells of the treated tissues is particularly valuable to host patients and other high risk factor subjects wherein conventional treatments have been unsuccessful.

Even more striking as mentioned earlier, early prevention therapies can be employed to stimulate tissue or organ modeling to be maintained within acceptable ranges prior to an exposure to a degenerative failure. This is extremely valuable in the prevention of spreading the infection or degenerative condition for example. The methods would be to identify at risk patients with a known exposure risk, and subjecting that patient to therapeutic shock wave therapy for the purpose of stimulating neurological tissue repair or regeneration effectively remodeling the patient's susceptible organs to be within accepted functional parameters prior to irreparable degeneration. The objective being to preventively stimulate cellular tissue repairs to preemptively avoid a degenerative condition from occurring which may result in the onset of a degenerative condition which can require invasive surgical procedures.

Figure 1A:
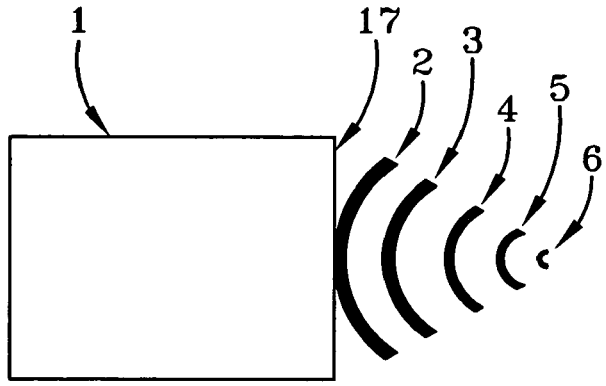
FIG. 1*a* is a simplified depiction of a pressure pulse/shock wave (PP/SW) generator with focusing wave characteristics.

This preventive therapy is most needed to combat conditions which left untreated results in cellular destruction or any other degenerative conditions FIG. 1*a* is a simplified depiction of the a pressure pulse/shock wave (PP/SW) generator, such as a shock wave head, showing focusing characteristics of transmitted acoustic pressure pulses. Numeral 1 indicates the position of a generalized pressure pulse generator, which generates the pressure pulse and, via a focusing element, focuses it outside the housing to treat diseases. The affected tissue or organ is generally located in or near the focal point which is located in or near position 6. At position 17 a water cushion or any other kind of exit window for the acoustical energy is located.

Figure 1B:
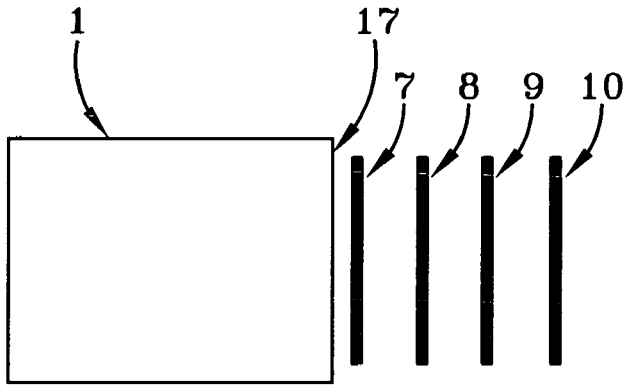
FIG. 1*b* is a simplified depiction of a pressure pulse/shock wave generator with plane wave characteristics.

FIG. 1*b* is a simplified depiction of a pressure pulse/shock wave generator, such as a shock wave head, with plane wave characteristics. Numeral 1 indicates the position of a pressure pulse generator according to the present invention, which generates a pressure pulse which is leaving the housing at the position 17, which may be a water cushion or any other kind of exit window. Somewhat even (also referred to herein as "disturbed") wave characteristics can be generated, in case a paraboloid is used as a reflecting element, with a point source (e.g. electrode) that is located in the focal point of the paraboloid. The waves will be transmitted into the patient's body via a coupling media such as, e.g., ultrasound gel or oil and their amplitudes will be attenuated with increasing distance from the exit window 17.

Figure 1C:
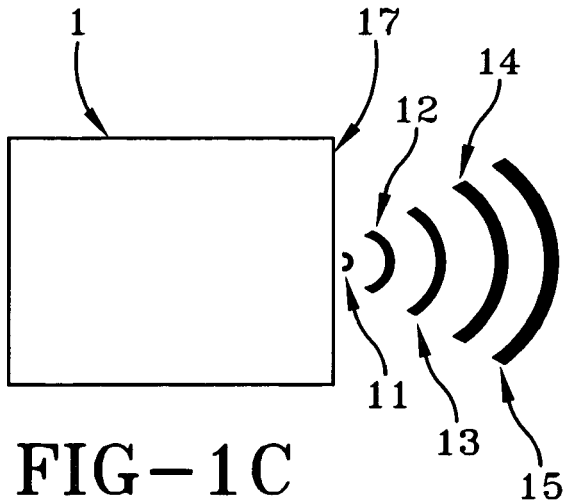
FIG. 1*c* is a simplified depiction of a pressure pulse/shock wave generator with divergent wave characteristics.

FIG. 1*c* is a simplified depiction of a pressure pulse shock wave generator (shock wave head) with divergent wave characteristics. The divergent wave fronts may be leaving the exit window 17 at point 11 where the amplitude of the wave front is very high. This point 17 could be regarded as the source point for the pressure pulses. In FIG 1*c* the pressure pulse source may be a point source, that is, the pressure pulse may be generated by an electrical discharge of an electrode under water between electrode tips. However, the pressure pulse may also be generated, for example, by an explosion, referred to as a ballistic pressure pulse. The divergent characteristics of the wave front may be a consequence of the mechanical setup shown in FIG. 2*b*.

Figure 2A:
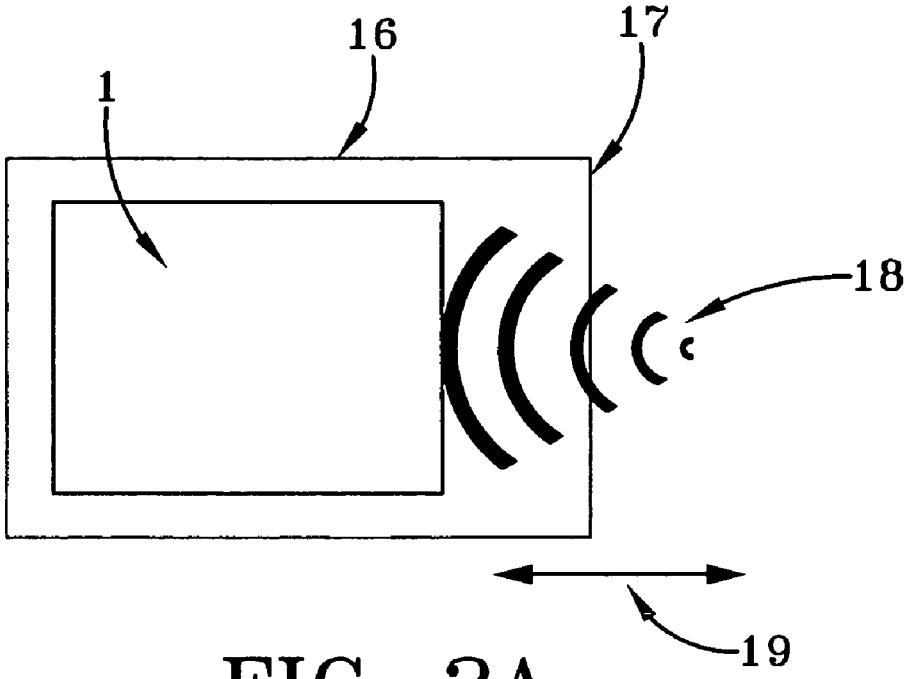
FIG. 2*a* is a simplified depiction of a pressure pulse/shock wave generator having an adjustable exit window along the pressure wave path. The exit window is shown in a focusing position.

FIG. 2*a* is a simplified depiction of a pressure pulse/shock wave generator (shock wave head) according to the present invention having an adjustable or exchangeable (collectively referred to herein as "movable") housing around the pressure wave path. The apparatus is shown in a focusing position. FIG. 2*a* is similar to FIG. 1*a* but depicts an outer housing (16) in which the acoustical pathway (pressure wave path) is located. In a preferred embodiment, this pathway is defined by especially treated water (for example, temperature controlled, conductivity and gas content adjusted water) and is within a water cushion or within a housing having a permeable membrane, which is acoustically favorable for the transmission of the acoustical pulses. In certain embodiments, a complete outer housing (16) around the pressure pulse/shock wave generator (1) may be adjusted by moving this housing (16) in relation to, e.g., the focusing element in the generator. However, as the person skilled in the art will appreciate, this is only one of many embodiments of the present invention. While the figure shows that the exit window (17) may be adjusted by a movement of the complete housing (16) relative to the focusing element, it is clear that a similar, if not the same, effect can be achieved by only moving the exit window, or, in the case of a water cushion, by filling more water in the volume between the focusing element and the cushion. FIG. 2*a* shows the situation in which the arrangement transmits focused pressure pulses.

Figure 2B:
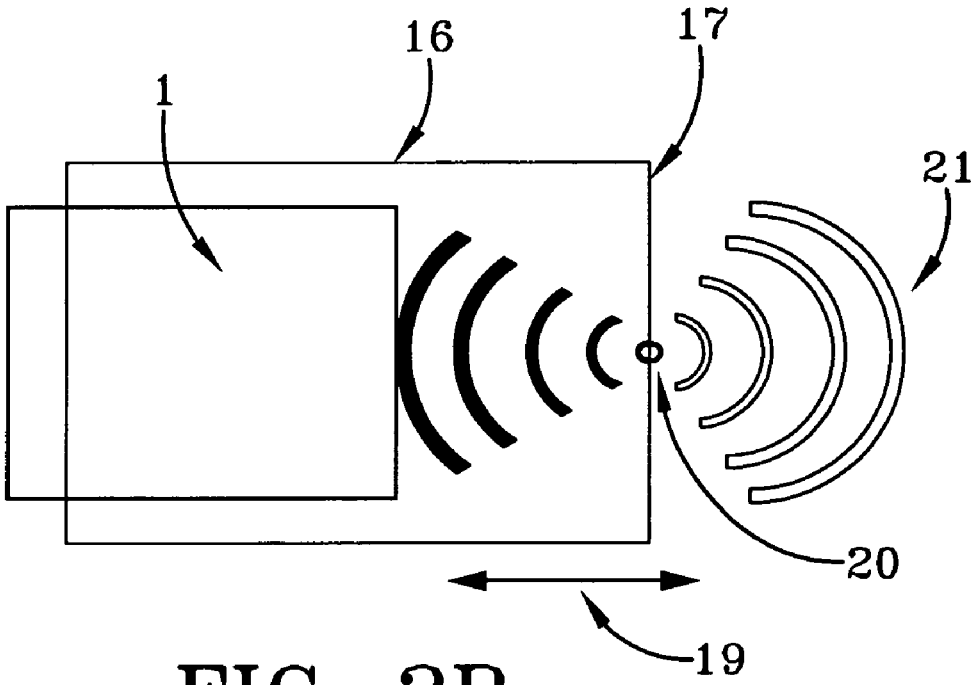
FIG. 2*b* is a simplified depiction of a pressure pulse/shock wave generator having an exit window along the pressure wave path. The exit window as shown is positioned at the highest energy divergent position.

FIG. 2*b* is a simplified depiction of the pressure pulse/shock wave generator (shock wave head) having an adjustable or exchangeable housing around the pressure wave path with the exit window 17 being in the highest energy divergent position. The configuration shown in FIG. 2*b* can, for example, be generated by moving the housing (16) including the exit window (17), or only the exit window (17) of a water cushion, towards the right (as shown in the Figure) to the second focus f2 (20) of the acoustic waves. In a preferred embodiment, the energy at the exit window will be maximal. Behind the focal point, the waves may be moving with divergent characteristics (21).

Figure 2C:
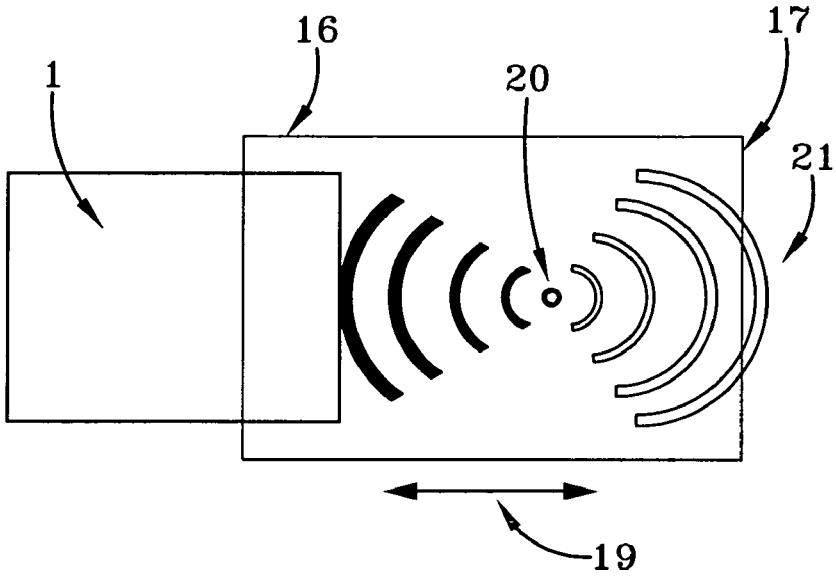
FIG. 2*c* is a simplified depiction of a pressure pulse/shock wave generator having an exit window along the pressure wave path. The exit window is shown at a low energy divergent position.

FIG. 2*c* is a simplified depiction of the pressure pulse/shock wave generator (shock wave head) having an adjustable or exchangeable housing around the pressure wave path in a low energy divergent position. The adjustable housing or water cushion is moved or expanded much beyond f2 position (20) so that highly divergent wave fronts with low energy density values are leaving the exit window (17) and may be coupled to a patient's body. Thus, an appropriate adjustment can change the energy density of a wave front without changing its characteristic.

This apparatus may, in certain embodiments, be adjusted/modified/or the complete shock wave head or part of it may be exchanged so that the desired and/or optimal acoustic profile such as one having wave fronts with focused, planar, nearly plane, convergent or divergent characteristics can be chosen.

A change of the wave front characteristics may, for example, be achieved by changing the distance of the exit acoustic window relative to the reflector, by changing the reflector geometry, by introducing certain lenses or by removing elements such as lenses that modify the waves produced by a pressure pulse/shock wave generating element. Exemplary pressure pulse/shock wave sources that can, for example, be exchanged for each other to allow an apparatus to generate waves having different wave front characteristics are described in detail below.

In certain embodiments, the change of the distance of the exit acoustic window can be accomplished by a sliding movement. However, in other embodiments of the present invention, in particular, if mechanical complex arrangements, the movement can be an exchange of mechanical elements.

In one embodiment, mechanical elements that are exchanged to achieve a change in wave front characteristics include the primary pressure pulse generating element, the focusing element, the reflecting element, the housing and the membrane. In another embodiment, the mechanical elements further include a closed fluid volume within the housing in which the pressure pulse is formed and transmitted through the exit window.

In one embodiment, the apparatus of the present invention is used in combination therapy. Here, the characteristics of waves emitted by the apparatus are switched from, for example, focused to divergent or from divergent with lower energy density to divergent with higher energy density. Thus, effects of a pressure pulse treatment can be optimized by using waves having different characteristics and/or energy densities, respectively.

While the above described universal toolbox of the present invention provides versatility, the person skilled in the art will appreciate that apparatuses that only produce waves having, for example, nearly plane characteristics, are less mechanically demanding and fulfill the requirements of many users.

As the person skilled in the art will also appreciate that embodiments shown in the drawings are independent of the generation principle and thus are valid for not only electrohydraulic shock wave generation but also for, but not limited to, PP/SW generation based on electromagnetic, piezoceramic and ballistic principles. The pressure pulse generators may, in certain embodiments, be equipped with a water cushion that houses water which defines the path of pressure pulse waves that is, through which those waves are transmitted. In a preferred embodiment, a patient is coupled via ultrasound gel or oil to the acoustic exit window (17), which can, for example, be an acoustic transparent membrane, a water cushion, a plastic plate or a metal plate.

Figure 3:
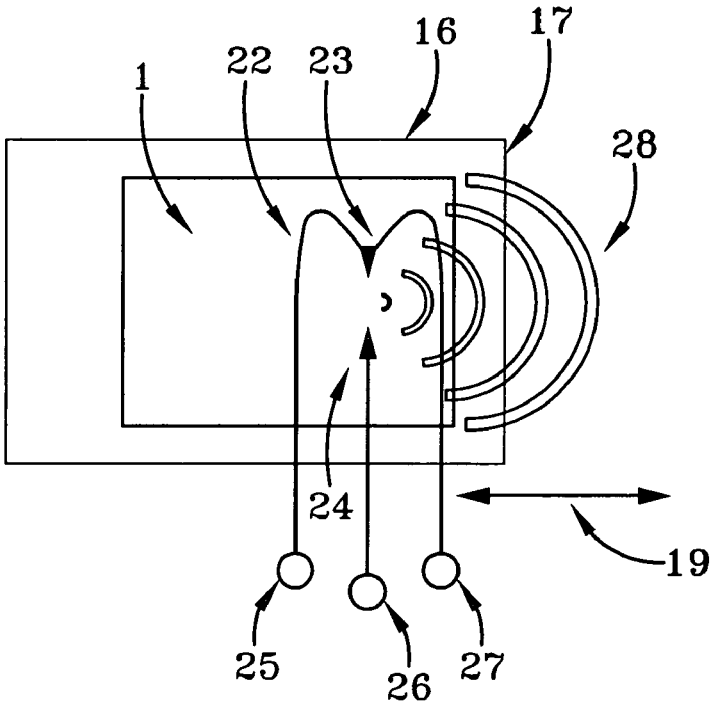
FIG. 3 is a simplified depiction of an electro-hydraulic pressure pulse/shock wave generator having no reflector or focusing element. Thus, the waves of the generator did not pass through a focusing element prior to exiting it.

FIG. 3 is a simplified depiction of the pressure pulse/shock wave apparatus having no focusing reflector or other focusing element. The generated waves emanate from the apparatus without coming into contact with any focusing elements. FIG. 3 shows, as an example, an electrode as a pressure pulse generating element producing divergent waves (28) behind the ignition point defined by a spark between the tips of the electrode (23, 24).

Figure 4A:
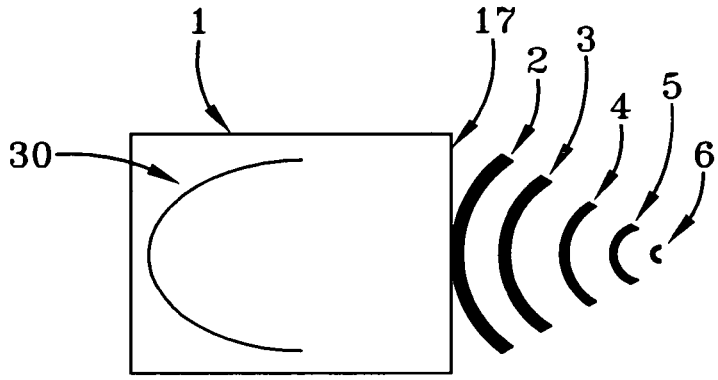
FIG. 4*a* is a simplified depiction of a pressure pulse/shock wave generator having a focusing element in the form of an ellipsoid. The waves generated are focused.

FIG. 4*a* is a simplified depiction of the pressure pulse/shock wave generator (shock wave head) having as focusing element an ellipsoid (30). Thus, the generated waves are focused at (6).

Figure 4B:
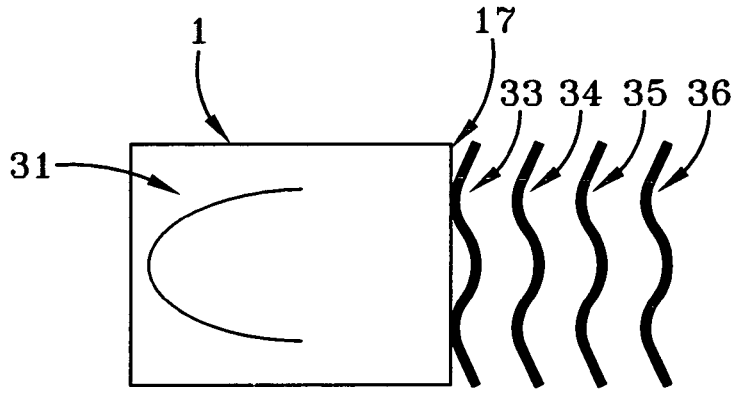
FIG. 4*b* is a simplified depiction of a pressure pulse/shock wave generator having a parabolic reflector element and generating waves that are disturbed plane.

FIG. 4*b* is a simplified depiction of the pressure pulse/shock wave generator (shock wave head) having as a focusing element an paraboloid ($y^2=2px$). Thus, the characteristics of the wave fronts generated behind the exit window (33, 34, 35, and 36) are disturbed plane ("parallel"), the disturbance resulting from phenomena ranging from electrode burn down, spark ignition spatial variation to diffraction effects. However, other phenomena might contribute to the disturbance.

Figure 4C:
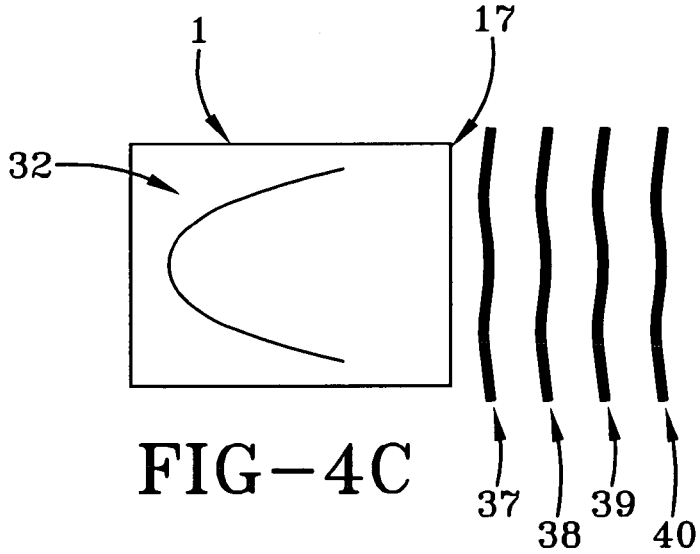
FIG. 4*c* is a simplified depiction of a pressure pulse/shock wave generator having a quasi parabolic reflector element (generalized paraboloid) and generating waves that are nearly plane/have nearly plane characteristics.

FIG. 4*c* is a simplified depiction of the pressure pulse/shock wave generator (shock wave head) having as a focusing element a generalized paraboloid ($y^n=2px$, with $1.2<n<2.8$ and $n\neq2$). Thus, the characteristics of the wave fronts generated behind the exit window (37, 38, 39, and 40) are, compared to the wave fronts generated by a paraboloid ($y^2=2px$), less disturbed, that is, nearly plane (or nearly parallel or nearly even (37, 38, 39, 40)). Thus, conformational adjustments of a regular paraboloid ($y^2=2px$) to produce a generalized paraboloid can compensate for disturbances from, e.g., electrode burn down. Thus, in a generalized paraboloid, the characteristics of the wave front may be nearly plane due to its ability to compensate for phenomena including, but not limited to, burn down of the tips of the electrode and/or for disturbances caused by diffraction at the aperture of the paraboloid. For example, in a regular paraboloid ($y^2=2px$) with $p=1.25$, introduction of a new electrode may result in p being about 1.05. If an electrode is used that adjusts itself to maintain the distance between the electrode tips ("adjustable electrode") and assuming that the electrodes burn down is 4 mm ($z=4$ mm), p will increase to about 1.45. To compensate for this burn down, and here the change of p, and to generate nearly plane wave fronts over the life span of an electrode, a generalized paraboloid having, for example $n=1.66$ or $n=2.5$ may be used. An adjustable electrode is, for example, disclosed in U.S. Pat. No. 6,217,531.

Figure 4D:
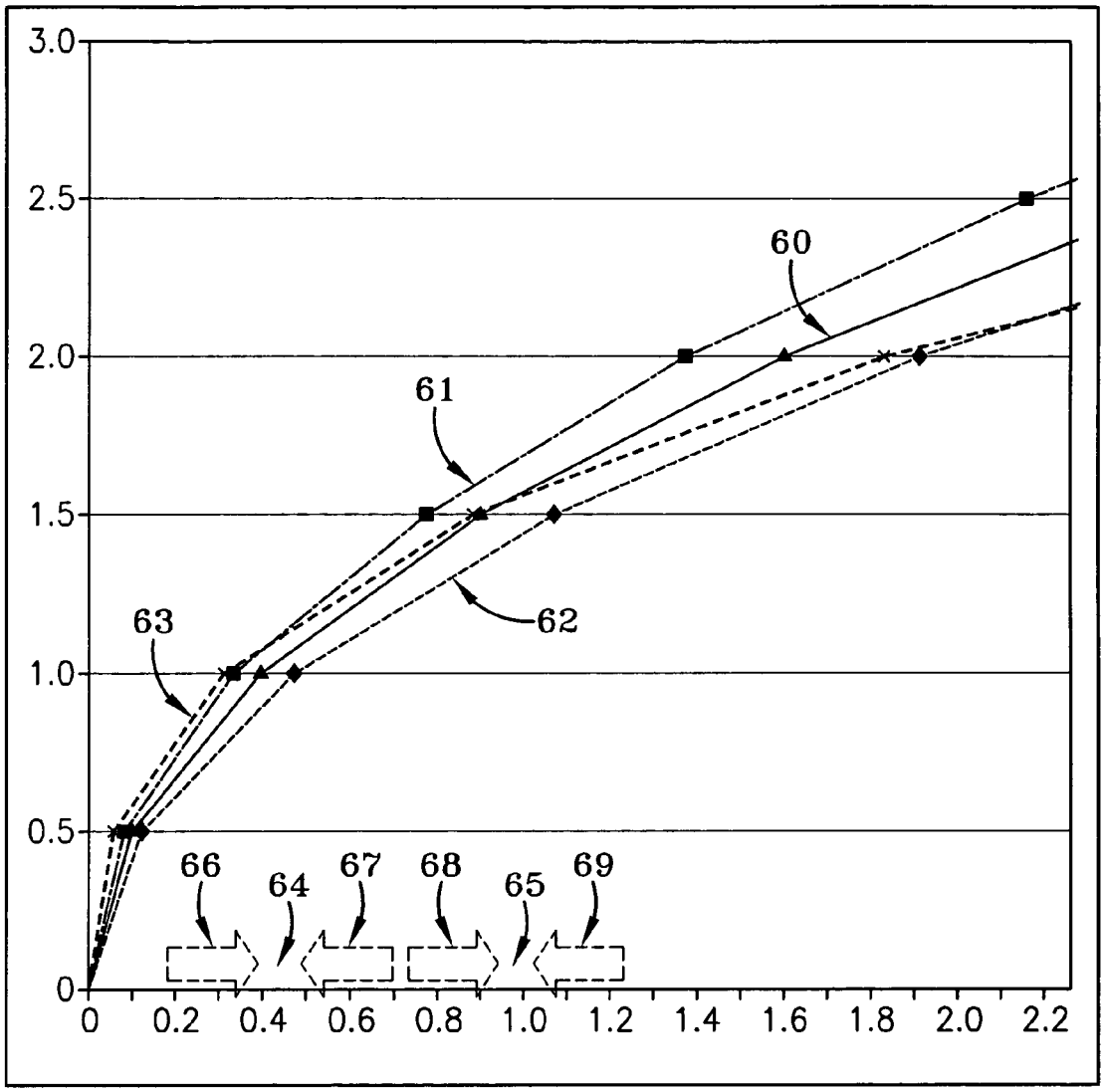
FIG. 4*d* is a simplified depiction of a generalized paraboloid with better focusing characteristic than a paraboloid in which n=2. The electrode usage is shown. The generalized paraboloid, which is an interpolation (optimization) between two optimized paraboloids for a new electrode and for a used (burned down) electrode is also shown.

FIG. 4*d* shows sectional views of a number of paraboloids. Numeral 62 indicates a paraboloid of the shape $y^2=2px$ with $p=0.9$ as indicated by numeral 64 at the x axis which specifies the p/2 value (focal point of the paraboloid). Two electrode tips of a new electrode 66 (inner tip) and 67 (outer tip) are also shown in the Figure. If the electrodes are fired and the tips are burning down the position of the tips change, for example, to position 68 and 69 when using an electrode which adjusts its position to compensate for the tip burn down. In order to generate pressure pulse/shock waves having nearly plane characteristics, the paraboloid has to be corrected in its p value. The p value for the burned down electrode is indicate by 65 as $p/2=1$. This value, which constitutes a slight exaggeration, was chosen to allow for an easier interpretation of the Figure. The corresponding paraboloid has the shape indicated by 61, which is wider than paraboloid 62 because the value of p is increased. An average paraboloid is indicated by numeral 60 in which $p=1.25$ cm. A generalized paraboloid is indicated by dashed line 63 and constitutes a paraboloid having a shape between paraboloids 61 and 62. This particular generalized paraboloid was generated by choosing a value of $n\neq2$ and a p value of about 1.55 cm. The generalized paraboloid compensates for different p values that result from the electrode burn down and/or adjustment of the electrode tips.

Figure 5:
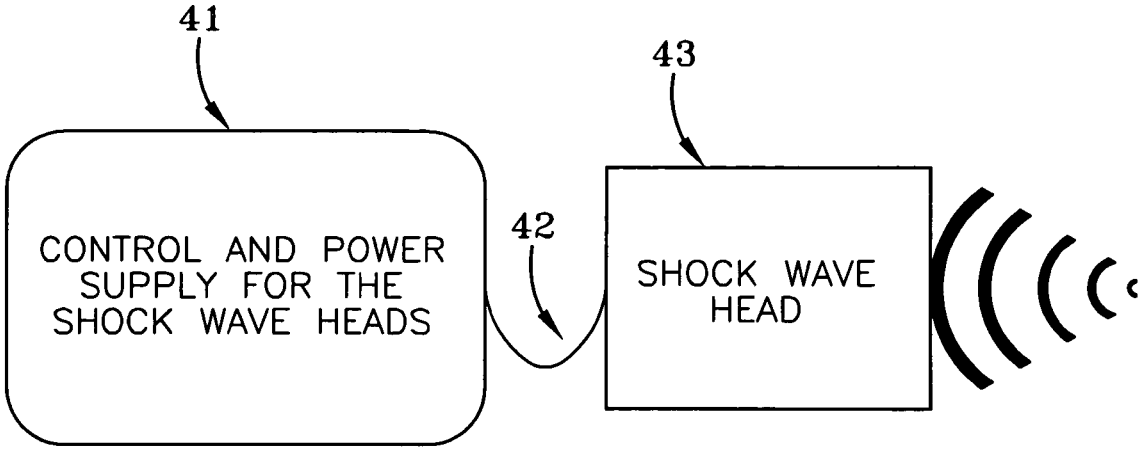
FIG. 5 is a simplified depiction of a pressure pulse/shock wave generator being connected to a control/power supply unit.

FIG. 5 is a simplified depiction of a set-up of the pressure pulse/shock wave generator (43) (shock wave head) and a control and power supply unit (41) for the shock wave head (43) connected via electrical cables (42) which may also include water hoses that can be used in the context of the present invention. However, as the person skilled in the art will appreciate, other set-ups are possible and within the scope of the present invention.

Figure 6:
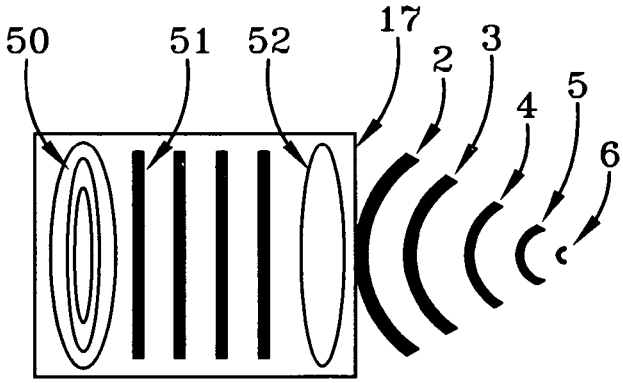
FIG. 6 is a simplified depiction of a pressure pulse/shock wave generator comprising a flat EMSE (electromagnetic shock wave emitter) coil system to generate nearly plane waves as well as an acoustic lens. Convergent wave fronts are leaving the housing via an exit window.

FIG. 6 is a simplified depiction of the pressure pulse/shock wave generator (shock wave head) having an electromagnetic flat coil 50 as the generating element. Because of the plane surface of the accelerated metal membrane of this pressure pulse/shock wave generating element, it emits nearly plane waves which are indicated by lines 51. In shock wave heads, an acoustic lens 52 is generally used to focus these waves. The shape of the lens might vary according to the sound velocity of the material it is made of. At the exit window 17 the focused waves emanate from the housing and converge towards focal point 6.

Figure 7:
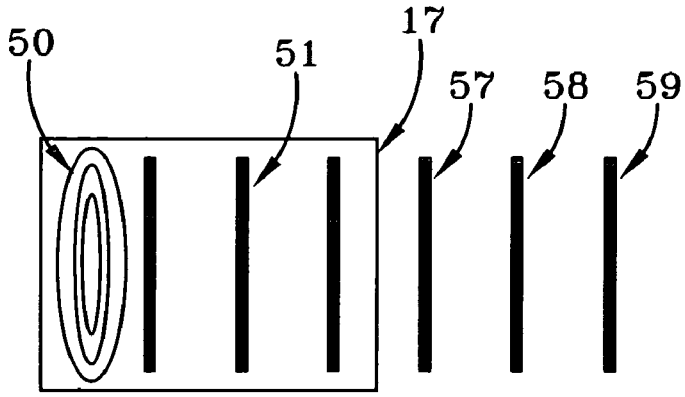
FIG. 7 is a simplified depiction of a pressure pulse/shock wave generator having a flat EMSE coil system to generate nearly plane waves. The generator has no reflecting or focusing element. As a result, the pressure pulse/shock waves are leaving the housing via the exit window unfocused having nearly plane wave characteristics.

FIG. 7 is a simplified depiction of the pressure pulse/shock wave generator (shock wave head) having an electromagnetic flat coil 50 as the generating element. Because of the plane surface of the accelerated metal membrane of this generating element, it emits nearly plane waves which are indicated by lines 51. No focusing lens or reflecting lens is used to modify the characteristics of the wave fronts of these waves, thus nearly plane waves having nearly plane characteristics are leaving the housing at exit window 17.

Figure 8:
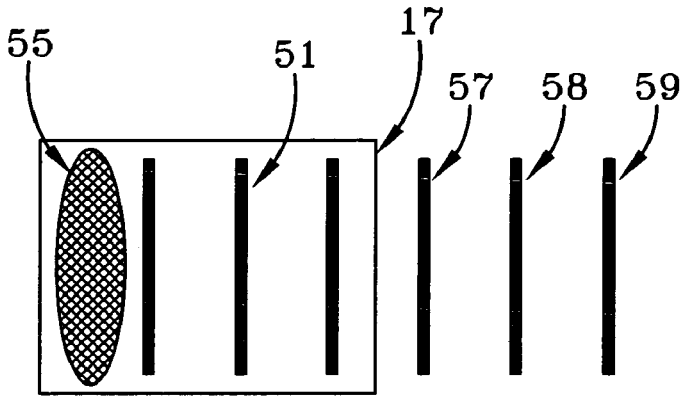
FIG. 8 is a simplified depiction of a pressure pulse/shock wave generator having a flat piezoceramic plate equipped with a single or numerous individual piezoceramic elements to generate plane waves without a reflecting or focusing element. As a result, the pressure pulse/shock waves are leaving the housing via the exit window unfocused having nearly plane wave characteristics.

FIG. 8 is a simplified depiction of the pressure pulse/shock wave generator (shock wave head) having an piezoceramic flat surface with piezo crystals 55 as the generating element. Because of the plane surface of this generating element, it emits nearly plane waves which are indicated by lines 51. No focusing lens or reflecting lens is used to modify the characteristics of the wave fronts of these waves, thus nearly plane waves are leaving the housing at exit window 17. Emitting surfaces having other shapes might be used, in particular curved emitting surfaces such as those shown in FIGS. 4*a* to 4*c* as well as spherical surfaces. To generate waves having nearly plane or divergent characteristics, additional reflecting elements or lenses might be used. The crystals might, alternatively, be stimulated via an electronic control circuit at different times, so that waves having plane or divergent wave characteristics can be formed even without additional reflecting elements or lenses.

Figure 9:
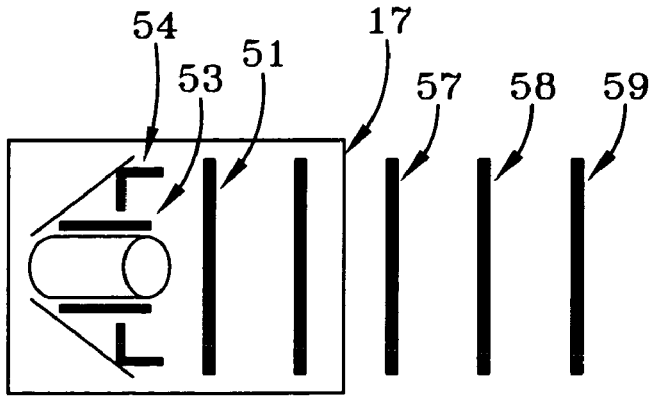
FIG. 9 is a simplified depiction of a pressure pulse/shock wave generator having a cylindrical EMSE system and a triangular shaped reflecting element to generate plane waves. As a result, the pressure pulse/shock waves are leaving the housing via the exit window unfocused having nearly plane wave characteristics.

FIG. 9 is a simplified depiction of the pressure pulse/shock wave generator (shock wave head) comprising a cylindrical electromagnet as a generating element 53 and a first reflector having a triangular shape to generate nearly plane waves 54 and 51. Other shapes of the reflector or additional lenses might be used to generate divergent waves as well.

Figure 10:
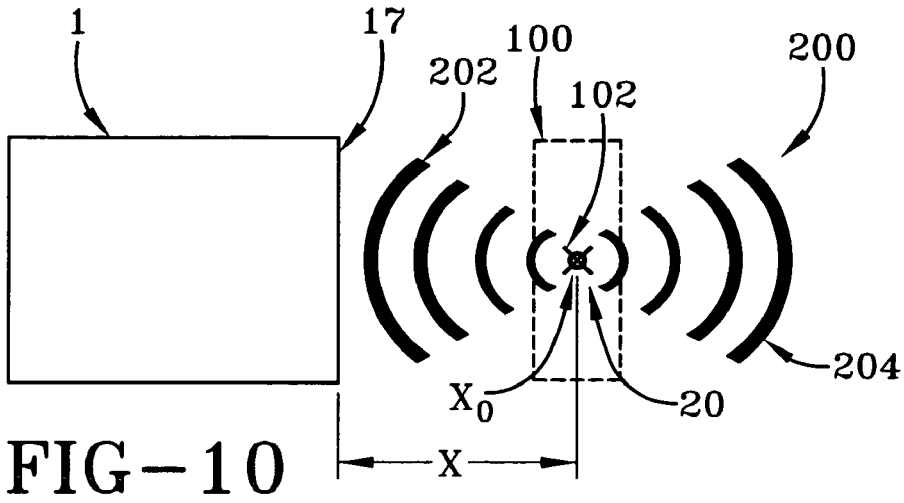
FIG. 10 is a simplified depiction of a pressure pulse/shock wave (PP/SW) generator with focusing wave characteristics shown focused with the focal point or geometrical focal volume being on an organ, the focus being targeted on the location $X_0$.
Figure 11:
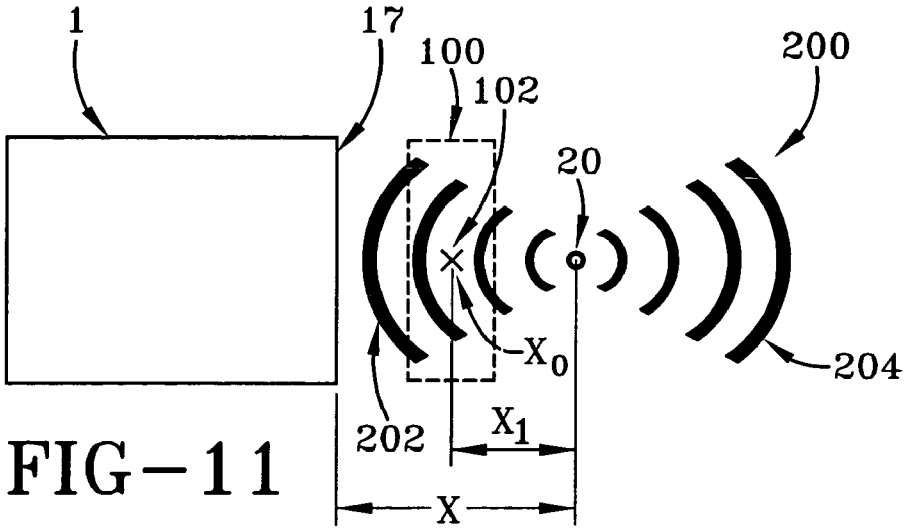
FIG. 11 is a simplified depiction of a pressure pulse/shock wave (PP/SW) generator with the focusing wave characteristics shown wherein the focus is located a distance X, from the location $X_0$ of an organ wherein the converging waves impinge the organ.
Figure 12:
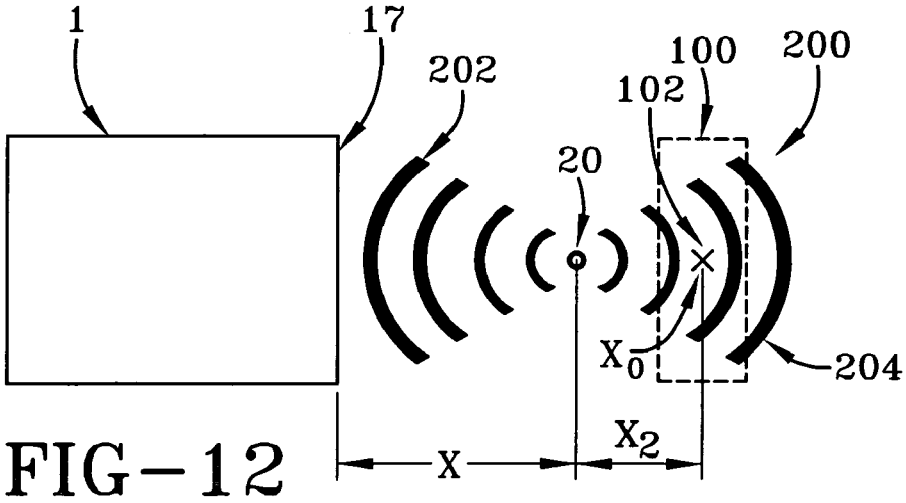
FIG. 12 is a simplified depiction of a pressure pulse/shock wave (PP/SW) generator with focusing wave characteristics shown wherein the focus is located a distance $X_2$ from the mass location $X_0$ wherein the emitted divergent waves impinge the organ.

With reference to FIGS. 10, 11 and 12 a schematic view of a shock wave generator or source 1 is shown emitting a shock wave front 200 from an exit window 17. The shock wave front 200 has converging waves 202 extending to a focal point or focal geometric volume 20 at a location spaced a distance X from the generator or source 1. Thereafter the wave front 200 passes from the focal point or geometric volume 20 in a diverging wave pattern as has been discussed in the various other FIGS. 1-9 generally.

With particular reference to FIG. 10 a tissue 100 is shown generally centered on the focal point or volume 20 at a location $X_0$ within the tissue 100. In this orientation the emitted waves are focused and thus are emitting a high intensity acoustic energy at the location $X_0$. This location $X_0$ can be anywhere within or on the organ. Assuming the tissue 100 is a brain tissue having a tumorous mass 102 at location $X_0$ then the focus is located directly on the mass 102. In one method of treating an infection or mass 102 these focused waves can be directed to destroy or otherwise reduce the mass 102 by weakening the outer barrier shield of the mass 102.

With reference to FIG. 11, the tissue 100 is shifted a distance X toward the generator or source 1. The tissue 100 at location $X_0$ being positioned a distance $X-X_1$ from the source 1. This insures the tissue 100 is impinged by converging waves 202 but removed from the focal point 20. When the tissue 100 is tissue this bombardment of converging waves 202 stimulates the cells activating the desired healing response as previously discussed.

With reference to FIG. 12, the tissue 100 is shown shifted or located in the diverging wave portion 204 of the wave front 200. As shown $X_0$ is now at a distance $X_2$ from the focal point or geometric volume 20 located at a distance X from the source 1. Accordingly $X_0$ is located a distance $X+X_2$ from the source 1. As in FIG. 10 this region of diverging waves 204 can be used to stimulate the tissue 100 which when the tissue is a cellular tissue stimulates the cells to produce the desired healing effect or response.

Heretofore invasive techniques were not used in combination with shock wave therapy primarily because the shock waves were believed to be able to sufficiently pass through interfering body tissue to achieve the desired result in a non-invasive fashion. While this may be true, in many cases if the degenerative process is such that an operation is required then the combination of an operation in conjunction with shock wave therapy only enhances the therapeutic values and the healing process of the patient and the infected organ such that regenerative conditions can be achieved that would include not only revascularization of neurological tissue, but also the heart or other organs wherein sufficient or insufficient blood flow is occurring but also to enhance the improvement of ischemic tissue that may be occupying a portion of the infected tissue or organ. This ischemic tissue can then be minimized by the regenerative process of using shock wave therapy in the fashion described above to permit the tissue to rebuild itself in the region that has been afflicted.

As shown in FIGS. 1-12 the use of these various acoustic shock wave forms can be used separately or in combination to achieve the desired therapeutic effect of destroying a mass 102 or regenerating nerve growth or neurological cells.

Furthermore such acoustic shock wave forms can be used in combination with drugs, chemical treatments, irradiation therapy or even physical therapy and when so combined the stimulated cells will more rapidly assist the body's natural healing response and thus overcomes the otherwise potentially tissue damaging effects of these complimentary procedures.

The present invention provides an apparatus for an effective treatment of indications, which benefit from high or low energy pressure pulse/shock waves having focused or unfocused, nearly plane, convergent or even divergent characteristics. With an unfocused wave having nearly plane, plane, convergent wave characteristic or even divergent wave characteristics, the energy density of the wave may be or may be adjusted to be so low that side effects including pain are very minor or even do not exist at all.

In certain embodiments, the apparatus of the present invention is able to produce waves having energy density values that are below 0.1 $mJ/mm^2$ or even as low as 0.000 001 mJ/mm2. In a preferred embodiment, those low end values range between 0.1-0.001 mJ/mm2. With these low energy densities, side effects are reduced and the dose application is much more uniform. Additionally, the possibility of harming surface tissue is reduced when using an apparatus of the present invention that generates unfocused waves having planar, nearly plane, convergent or divergent characteristics and larger transmission areas compared to apparatuses using a focused shock wave source that need to be moved around to cover the affected area. The apparatus of the present invention also may allow the user to make more precise energy density adjustments than an apparatus generating only focused shock waves, which is generally limited in terms of lowering the energy output. Nevertheless in some cases the first use of a high energy focused shock wave targeting the biomass or tumor may be the best approach to weaken the outer barrier of the shield of the biomass followed by a transmission of lower energy unfocused wave patterns, the combination being the most effective in germicidal destruction of the tumorous masses.

The treatment of the above mentioned tissue, organ or body of a patient is believed to be a first time use of acoustic shock wave therapy in the preventive pre-exposure or post-exposure to neurological tissues or organs or nerve damage or degeneration of said tissues or organs. None of the work done to date has treated the above mentioned treatments with convergent, divergent, planar or near-planar acoustic unfocused shock waves of low energy or high energy focused shock waves in a germicidal transmission path from the emitting source lens or cover to the infection or target site. Also this is believed to be a first time use of acoustic shock waves for germicidal wound cleaning or preventive medical treatments for such exposures after nerve or brain trauma. The use of the methods of the present invention are particularly useful in the reattachment of severed limbs and tissue. It is hoped that the use of the present invention will reduce the number of cases of amputations in severe injury cases.

It will be appreciated that the apparatuses and processes of the present invention can have a variety of embodiments, only a few of which are disclosed herein. It will be apparent to the artisan that other embodiments exist and do not depart from the spirit of the invention. Thus, the described embodiments are illustrative and should not be construed as restrictive.

The use of acoustic shock waves to patients exposed to neurological infections or nerve trauma stimulates a cellular response of the treated tissues as well as a cellular response in the surrounding tissue. This response activates otherwise dormant cells to increase the body's own defense mechanisms, allowing the cells to limit the migration of the infection and resultant tissue damage, but also to initiate the healing process. This feature means that the treating physician has the added benefit of a patient whose body will be strengthened to mitigate damage to otherwise healthy tissues and organs.

The nature of infectious disease treatments employing only antibiotics to kill infections is well known to actually make microorganisms mutate making them even harder to kill. The result is the patient is in a greatly weakened state overall. These mutant strains are so severe that the common antibiotic treatments are losing their ability to stop the spread of some infections which is well documented. These symptoms are generally reversible. The more serious complications may not be reversible. These antibiotic treatments can be cumulative in their adverse reactions and thus the effective treatment of the infections can also permanently damage otherwise healthy tissue and organs. The use of the shock waves as described above stimulates these healthy cells to defend against this spill over intrusion.

This means the physician can use these antibiotic treatments with far less adverse reactions if he combines the treatments with one or more exposures to acoustic shock waves either before introducing chemical antibiotic agents or shortly thereafter or both. This further means that the patient's recovery time should be greatly reduced because the patient treated with shock waves will have initiated a healing response that is much more aggressive than heretofore achieved without the cellular stimulation provided by pressure pulse or shock wave treatments. The current use of medications to stimulate such cellular activity is limited to absorption through the bloodstream via the blood vessels. Acoustic shock waves stimulate all the cells in the region treated activating an almost immediate cellular release of infection fighting and healing agents. Furthermore, as the use of other wise conflicting chemicals is avoided, adverse side effects can be limited to those medicaments used to destroy the infectious cells. In other words the present invention is far more complimentary to such antibiotic treatments in that the stimulation of otherwise healthy cells will greatly limit the adverse and irreversible effects on the surrounding non-infected tissues and organs.

A further benefit of the use of acoustic shock waves is there are no known adverse indications when combined with the use of other medications or drugs. In fact the activation of the cells exposed to shock wave treatments only enhances cellular absorption of such medication making these drugs faster acting than when compared to non stimulated cells. As a result, it is envisioned that the use of one or more medicaments prior to, during or after subjecting the patient to acoustic shock waves will be complimentary to the treatment or pre-conditioning treatment for nerve damage. It is further appreciated that certain drug therapies can be altered or modified to lower risk or adverse side effects when combined with a treatment involving acoustic shock waves as described above.

Variations in the present invention are possible in light of the description of it provided herein. While certain representative embodiments and details have been shown for the purpose of illustrating the subject invention, it will be apparent to those skilled in this art that various changes and modifications can be made therein without departing from the scope of the subject invention. It is, therefore, to be understood that changes can be made in the particular embodiments described which will be within the fill intended scope of the invention as defined by the following appended claims.

What is claimed is:

1. A method of treating a patient having injured or otherwise diseased nerves to stimulate by accelerating or initiating the regeneration and repair of injured or diseased nerves which comprises the step of:

treating the patient with injured or damaged nerves;

activating an acoustic pressure pulse shock wave generator or source to emit a pressure pulse or acoustic shock waves from a shock wave head, the pressure pulse being an acoustic pulse which includes several cycles of positive and negative pressure, wherein the pressure pulse has an amplitude of the positive part of such a cycle should be above 0.1 MPa and the time duration of the pressure pulse is from below a microsecond to about a second, rise times of the positive part of the first pressure cycle in the range of nano-seconds (ns) up to some milli-seconds (ms), the acoustic shock waves being very fast pressure pulses having amplitudes above 0.1 MPa and rise times of the amplitude being below 100's of ns, the duration of the shock wave is typically below 1-3 micro-seconds (μs) for the positive part of a cycle and typically above some micro-seconds for the negative part of a cycle; and subjecting the nerves to convergent, divergent, planar or near planar acoustic shock waves or pressure pulses in the absence of a focal point impinging the nerves stimulating a cellular response in the absence of creating cavitation bubbles evidenced by not experiencing the sensation of hemorrhaging in the nerve caused by the emitted waves or pulses wherein the nerve is positioned within an unobstructed path of the emitted shock waves or pressure pulses; and away from any localized geometric focal volume or point of the emitted shock waves wherein the emitted shock waves or pressure pulses either have no geometric focal volume or point or have a focal volume or point ahead of the nerve or beyond the nerve thereby passing the emitted waves or pulses through the nerve while avoiding having any localized focal point within the nerve wherein the emitted pressure pulses or shock waves are convergent, divergent, planar or near planar and the pressure pulse shock wave generator or source is based on electro-hydraulic, electromagnetic, piezoceramic or ballistic wave generation having an energy density value ranging as low as 0.00001 $mJ/mm^2$ to a high end of below 1.0 $mJ/mm^2$; and by administering an effective exposure of pressure pulses or acoustic shock waves in a pulse or wave pattern having a low energy density less than 1.0 $mJ/mm^2$ per shock wave directly to a zone or treatment site of the injured or diseased nerves initiates or accelerates the regeneration and repair process wherein the zone or treatment site of the injured or diseased nerves is positioned directly in a path of the pulse or wave pattern in absence of any focal point or if a focal point exists, the zone or treatment site is positioned away from any focal point wherein the energy density is selected to avoid cell damage to the injured or otherwise diseased nerves within the treatment site or zone.

2. The method according to claim 1 wherein the nerve has been severed creating one or more ends of proximal stumps and distal stumps and a pulse or wave pattern is administered to the ends of the proximal and distal stumps.

3. The method according to claim 2 wherein fibrin containing collagenase is used as adhesive for the stumps.

4. The method according to claim 2 wherein the ends are sutured.

5. The method according to claim 4 wherein the sutured region is coated with a fibrin and collagenase mixture.

6. The method according to claim 2 wherein the stumps of individual severed fascicle groups are separately co-apted.

7. The method according to claim 2 wherein a nerve graft is interposed between the stumps.

8. The method according to claim 7 wherein interfascicular nerve grafts are employed.

9. The method according to claim 1 wherein injury has resulted in neuroma in continuity.

10. The method according to claim 1 wherein the injured nerves are subjected to surgical repair prior to administering the exposure to pressure pulse or acoustic shock waves.

11. The method according to claim 1 wherein the method further comprises the step of:

administering one or more nerve regenerating medicaments to the patient.

12. A method of treating a patient with a neurological disorder or injury to the brain by treating the neuronal cells of the brain tissue to stimulate by accelerating and increasing nerve or neurological brain tissue growth or regeneration or repair comprises the steps of:

treating a patient with a neurological disorder or injury to the brain by treating the neuronal cells of the brain tissue;

activating an acoustic shock wave or pressure pulse generator or source to emit a pressure pulses or acoustic shock waves, the pressure pulse being an acoustic pulse which includes several cycles of positive and negative pressure, wherein the pressure pulse has an amplitude of the positive part of such a cycle should be above 0.1 MPa and the time duration of the pressure pulse is from below a microsecond to about a second, rise times of the positive part of the first pressure cycle in the range of nanoseconds (ns) up to some milli-seconds (ms), the acoustic shock waves being very fast pressure pulses having amplitudes above 0.1 MPa and rise times of the amplitude being below 100's of ns, the duration of the shock wave is typically below 1-3 micro-seconds (μs) for the positive part of a cycle and typically above some microseconds for the negative part of a cycle; and subjecting the neuronal cells to convergent, divergent, planar or near planar acoustic shock waves or pressure pulses in the absence of a focal point impinging the neuronal cells stimulating a cellular response in the absence of creating cavitation bubbles evidenced by not experiencing the sensation of hemorrhaging caused by the emitted waves or pulses in the neuronal cells wherein the neuronal cells are positioned within an unobstructed path of the emitted shock waves or pressure pulses; and away from any localized geometric focal volume or point of the emitted shock waves wherein the emitted shock waves or pressure pulses either have no geometric focal volume or point or have a focal volume or point ahead of the neuronal cells or beyond the neuronal cells thereby passing the emitted waves or pulses through the neuronal cells while avoiding having any localized focal point within the neuronal cells of the brain wherein the emitted pressure pulses or shock waves are convergent, divergent, planar or near planar and the pressure pulse shock wave generator or source is based on electro-hydraulic, electromagnetic, piezoceramic or ballistic wave generation having an energy density value ranging as low as 0.00001 $mJ/mm^2$ to a high end of below 1.0 $mJ/mm^2$; and by subjecting the neuronal cells of the neurological organ tissue or nerve tissue directly to the acoustic shock waves having a low energy density of less than 1.0 $mJ/mm^2$ per shock wave stimulates said neuronal cells or brain tissue wherein the neuronal cells or brain tissue is positioned directly within a path of the emitted pressure pulses or acoustic shock waves in the absence of any focal point or if a focal point exists, the neuronal cells or brain tissue being treated is positioned away from any focal point wherein the energy density is selected to avoid any cell damage to the neuronal cells or brain tissue.

13. The method of treating neuronal cells to stimulate by accelerating or increasing neuronal cell growth or regeneration according to claim 12 wherein the administering is applied to a patient who has a pathological condition where neuronal repair can be facilitated including peripheral nerve damage caused by injury or disease such as diabetes, brain damage associated with stroke, and for the treatment of neurological disorders related to neurodegeneration, including Parkinson's disease, Alzheimer's disease and amyotrophic lateral sclerosis, multiple sclerosis and disseminated sclerosis.

14. The method of treating neuronal cells to stimulate by accelerating and increasing nerve or neurological brain tissue growth or regeneration or repair according to claim 12 wherein the emitted shock waves or pressure pulses are convergent having one or more geometric focal volumes or points at a distance of at least X from the generator or source, the method further comprising positioning the nerve or neurological brain tissue at a distance less than the distance X from the source.

15. The method of treating neuronal cells to stimulate by accelerating and increasing neuronal cell neurological brain tissue growth or regeneration or repair according to claim 12 wherein the neuronal cell or neurological brain tissue is from a mammal which is a human or an animal.

16. The method of treating neuronal cells to stimulate by accelerating and increasing cell or neurological brain tissue growth or regeneration or repair according to claim 12 wherein the step of subjecting the cells or neurological brain tissue to acoustic shock waves or pressure pulses includes killing bacteria by stimulating a biological defense mechanism within said cells or neurological brain tissue by exposure to the acoustic shock waves or pressure pulses.

17. The method of treating neuronal cells to stimulate by accelerating and increasing cell or neurological brain tissue growth or regeneration or repair according to claim 12 further comprises a step of administering one or more antibiotics or other drugs to a blood stream feeding the nerve or neurological organ, the cell or neurological brain tissue being stimulated by the acoustic shock waves or pressure pulses.

* * * * *